US006513424B1

(12) United States Patent
Iwasaki et al.

(10) Patent No.: US 6,513,424 B1
(45) Date of Patent: Feb. 4, 2003

(54) DEVICE AND METHOD FOR PROCESSING POWDER AND GRANULAR MATERIAL

(75) Inventors: Akira Iwasaki, Tokyo (JP); Toshinari Sasaki, Tokyo (JP); Shigetoshi Kashiwagi, Tokyo (JP); Shigemi Isobe, Tokyo (JP)

(73) Assignee: Freund Industrial Co., Ltd., Tokyo (JP)

( * ) Notice: Subject to any disclaimer, the term of this patent is extended or adjusted under 35 U.S.C. 154(b) by 0 days.

(21) Appl. No.: 09/647,897

(22) PCT Filed: Apr. 7, 1999

(86) PCT No.: PCT/JP99/01842

§ 371 (c)(1),
(2), (4) Date: Oct. 6, 2000

(87) PCT Pub. No.: WO99/52705

PCT Pub. Date: Oct. 21, 1999

(30) Foreign Application Priority Data

Sep. 4, 1998 (JP) ..... 10-97955
Sep. 4, 1998 (JP) ..... 10-97956

(51) Int. Cl.[7] ..... B30B 11/16; B30B 11/22

(52) U.S. Cl. ..... 100/40; 100/41; 100/168; 264/118

(58) Field of Search ..... 100/40, 41, 145, 100/155 R, 168, 176; 264/118, 145, 171.29

(56) References Cited

U.S. PATENT DOCUMENTS 3,886,249 A * 5/1975 Mangandro ..... 264/118

FOREIGN PATENT DOCUMENTS

| | | |
|---|---|---|
| JP | 48-89907 | 11/1973 |
| JP | 49-125281 | 11/1974 |
| JP | 50-56373 | 5/1975 |
| JP | 51-98682 | 8/1976 |
| JP | 51-123970 | 10/1976 |
| JP | 54-126674 | 10/1979 |
| JP | 61-136431 | 6/1986 |
| JP | 63-180198 | 11/1988 |
| JP | 01-044300 | 2/1989 |
| JP | 01-107999 | 4/1989 |
| JP | 05-069198 | 3/1993 |
| JP | 07-148599 | 6/1995 |
| JP | 09-194906 | 7/1997 |

* cited by examiner

*Primary Examiner*—W. Donald Bray
(74) *Attorney, Agent, or Firm*—McCormick, Paulding & Huber LLP

(57) ABSTRACT

A pair of compression rollers 38*a* and 38*b* parallel with each other are provided and powder grains are supplied to a powder grain introduction/compression part 50 formed between the rollers 38*a* and 38*b* and, thereby, compression moldings of the powder grains are formed. A powder grain press/feed means 20 is provided in a front stage of the rollers 38*a* and 38*b*. The press/feed means 20 has a deaerating barrel 24 and previously presses the powder grains supplied between the rollers 38*a* and 38*b*. In side surfaces of the rollers 38*a* and 38*b*, side seals 37 are arranged with clearances 72 maintained from the rollers 38*a* and 38*b*. During pressing the powder moldings, the powder grains enter into the clearances so that closer layers are formed between the side surfaces of the compression rollers 38*a* and 38*b* and the side seals 37, thereby sealing the powder grain introduction/compression part 50. In a rear stage of the rollers 38*a* and 38*b*, a shearing device 75 is provided and shears the compression moldings formed by the rollers 38*a* and 38*b*. Torque of the shearing device 75 is detected by a torque sensor, and the compression rollers 38*a* and 38*b* and the powder grain transport means 17 are controlled in accordance with the detected torque.

18 Claims, 16 Drawing Sheets

1
2
7
8
9
10
11
13
14
15
16
17
18
19
20
21
22
23
24
25
46
49
57
59
65
69
70

DEVICE AND METHOD FOR PROCESSING POWDER AND GRANULAR MATERIAL

TECHNICAL FIELD

The present invention relates to a powder grain processing technique used for manufacturing medicines, foods, agricultural chemicals, resins, fertilizers, and the like, and particularly to a technique effectively applicable to a dry granulation apparatus in which powder grains are compacted and formed to manufacture a product.

BACKGROUND ART

As methods for granulating powder grains to manufacture medicines and foods, there are a wet granulation method using wet materials such as water, alcohol or the like, and a dry granulation method in which dried powder grains are compacted and formed by a pair of compression rollers. The dry granulation method obtains stable granules without necessitating wet material and have advantages of shortening of processing time and increasing efficiency of production in order to omit an intermediate step used the wet granulation method. In recent years, frequency in use of the dry granulation method is promoted.

In this dry granulation method, both of the compression rollers receive such a force from supplied powder grains that pushes and opens between the rollers, as a reaction to a compressing force generated during compacting and forming. Therefore, in conventional cases, one of the compression rollers is provided with a hydraulic mechanism to press the other compression roller and, thereby, the other roller is prevented escaping from the one. A dry granulation apparatus of this kind is described, for example, in Japanese Patent Application Laid-Open No. 49-125281 and No. 50-56373. FIGS. 14(*a*) to 14(*c*) and 15 are explanatory views showing structures thereof.

Firstly, in the dry granulation apparatus shown in FIG. 14(*a*), a powder grain container hopper 101 is provided at an upside thereof to temporarily store powder grains 109 that are materials and are transported with air. A feeder 102 that have screw wings for transporting the powder grains 109 supplied from the hopper 101 in a lateral direction is installed at a lower portion of the container hopper 101. Compression rollers 104 for pressing, with a high pressure, the powder grains 109 fed by the feeder 102 to compress them at a high density are provided below the feeder 102. In this case, a press cylinder 105 is attached to one of the compression rollers 104. Further, the one roller 104 is pressed against other roller 104, so that the other roller 104 is prevented escaping from the one roller 104 during the compacting and forming.

A needle-shearing device 106 for shearing a compacted object that is fed from the rollers 104 is provided below the rollers 104. Provided below the shearing device 106 is a cutter-shearing device 107 for further shearing granulation sheared by the shearing device 106 to obtain granulation of appropriate shape. A grain refiner 108 for refining the sheared granulation is provided further below the device 107. Note that these devices are always disassembled into component parts for every lot of products or the like at every appropriate period in order to prevent contamination therein. The parts and process rooms are individually cleaned. In this manner, even with respect to medicinal supplies that should avoid mixture of foreign ingredients, an operation of granulation or the like can be achieved while the devices are consistently kept clean.

Meanwhile, even if the one roller 104 are pressed so as to prevent the other roller escaping from the one roller during the compacting, then powder grains for granulation escape from both end surfaces of the rollers 104. This results in insufficient compression force and causes a drawback that solid tablets having uniform quality cannot be obtained. To prevent this escape of the powder grains, the granulation apparatus shown in FIG. 14(*a*) is provided with seal plates 111 and 111 as shown in FIG. 14(*b*), in a positional relationship as shown in FIG. 14(*c*). In this case, a pressure-resistant device 113 that is operated by oil pressure or the like is provided on a back part of one of the seal plates 111. Also, by the pressure-resistant device 113, the seal plates 111 and 111 are pressed so as not to come apart from end surfaces of the rollers 104. Accordingly, the powder grains supplied between the rollers 104 and 104 are compacted and formed without escaping and flowing from therebetween.

And, the granulation apparatus shown in FIG. 15(*a*) is also provided with similar seal plates 125 and 125. In the granulation apparatus shown in FIG. 15(*a*), powder grains are supplied from a powder grain container hopper 121 through a screw feeder 122 to a pair of compression rollers 123 and 123. To prevent the supplied powder grains from escaping between the rollers 123 and 123 during the compacting and forming, seal plates 125 are provided on both end surface sides of the rollers. A hydraulic cylinder 124 is also provided at one of the rollers 123 as described above.

Next, with respect to supply of powder grains to the compression rollers, a screw feeder is used to supply powder grains in many cases as described above. A screw feeder is frequently used in apparatuses, which must feed powder grains, such as a powder packaging apparatus, a powder scale apparatus, and the like, including a granulation apparatus. In this case, there are, in particularly, no problems caused by supply efficiency of the screw feeders in powder grains having a small apparent specific volume. However, there is a drawback that the supply efficiency decreases as the apparent specific volume increases. For example, in a process of performing the compacting and forming by means of compression rollers, the compacting and forming is carried out without problems in case of powder grains having a small apparent specific volume (2.5 and less). On the other hand, if the apparent specific volume is slightly larger (4 to 5), the supply efficiency of the screw feeders decreases. This results in making bad a thrust of the powder grains between the compression rollers, decreasing capacity for compacting and forming the powder grains, and reducing production efficiency. Additionally, if the powder grains have a much larger apparent specific volume (5 and more), the thrust of the powder grains is made worse and, thereby, it is no longer possible to compact and form the powder grains.

Therefore, if the powder grains have a large apparent specific volume, then it is necessary to compress the powder grains twice by the rollers or to compress the powder grains after the powder grains are pre-compressed by another compression device and the apparent specific volume thereof is reduced. That is, this processing has some wasteful steps. Although various methods and apparatuses using a tapered screw, a wave-form roll, a large-diameter roller, or the like have been proposed, any of them cannot be a satisfactory solution. On the other hand, tries for reduction of the apparent specific volume of powder grains have been made. For example, in a fine powder granulation apparatus described in Japanese Patent Application Laid-Open No. 64-44300, a structure is proposed in which fine powder containing much air is subjected to degassing during transportation thereof.

In the apparatus according to the Japanese Patent Application Laid-Open No. 64-44300, as shown in FIG. 16, a filter cylinder 132 is provided inside a trough 131, and screw wings 133 are provided in this filter cylinder 132. In this case, a ring-like chamber 134 is formed between the trough 131 and the filter cylinder 132. In addition, the ring-like chamber 134 is connected to a vacuum pump not shown through a communication tube 135. In this apparatus, the fine powder 137 supplied to a hopper 136 is degassed by the vacuum pump while being fed to the compression rollers 138 by the screw wings 133. Accordingly, the fine powder 137 comes to have the small apparent specific volume and is supplied between the compression rollers 138.

Meanwhile, various control methods about a powder grain processing apparatus have been proposed to be able to obtain compacted objects having uniform thickness and hardness without depending on operator's intuition about thickness and hardness. FIG. 17 is an explanatory view showing a structure of a powder compression apparatus according to Japanese Patent Application Laid-Open No. 51-98682, which is an example of the above-mentioned proposition. In a dry granulating apparatus shown in FIG. 17, there are provided a supply hopper 141, a screw 143 rotated by a motor 142, and compression rollers 144 and 145. Powder grains supplied from the hopper 141 are compacted and formed between the rollers 144 and 145. In this respect, this apparatus is similar to a conventional one.

In this apparatus, however, at the rollers 144 and 145 are provided a thickness detection device 146 for detecting distance between the rollers, and a powder grain supply amount control device 147. The powder grain supply amount control device 147 controls rotation speed of the motor 142 in correspondence with a detected thickness and adjusts the powder grain supply amount from the hopper 141. In this case, a device in which a spring supports rotation shafts of the rollers 144 and 145 and which the distance between the rollers is detected on the basis of a pressure caused by the spring or a device in which the distance between the rollers 144 and 145 is detected with using a differential transformer is used as the thickness detection device 146.

However, the conventional powder grain processing apparatus as described above involves the following problems. At first, in the conventional powder grain processing apparatus, the compression rollers must be pressed by a hydraulic cylinder to increase the compacting and forming effect when compacting the powder grains. And, in order to increase the compacting and forming effect for compressing the powder grains with the rollers, seal plates must be pressed by the hydraulic cylinder. In addition, an actuator for pressing the seal plates or compression rollers, and equipment thereof are required, so that the mechanism of the apparatus is complicated and number of parts thereof is increased. This is a factor causing cost-up. Also, since powder grains attach to the actuator and equipment, contamination of the actuator and equipment may give damage to functions of the apparatus. Hence, it is desired to simplify the mechanism thereof.

Further, there are problems not preferred from view of GMP (Good Manufacturing Practice: manufacturing rules for medicines) for following reasons: products may be polluted by (hydraulic) leakage of fluid from a hydraulic cylinder, a pressure-resistance device, or the like; and abrasion powders that is abraded from the seal plates due to contact between the seal plates and the compression rollers may be mixed in the products. In this case, to prevent the abrasion powders from being generated, a hard seal material requires being used on contact portions between the seal plates and the compression rollers. These result in problems that the price of the seal plates increases and, thereby, the cost for manufacturing the apparatus raises.

In addition, in the conventional apparatus, the hopper, compression rollers and the like are individually detached from the apparatus and then are individually disassembled and cleaned. And, the process rooms are manually cleaned after putting out the apparatus. Therefore, since time and labor are required at cleaning, it is desired to improve the cleaning. In particular, cleaning must be carried out for every one of products that are subjected to batch processing, so that operation of the cleaning is very troublesome and complicated. And, since the cleaning operation tends to be done roughly, severe attention and management are required to achieve the cleaning in compliance with the GMP.

Meanwhile, in the device which detects behaviors of compression rollers to control the powder grain supply amount and to stabilize quality of compression moldings, the behaviors of the compression rollers are detected by a mechanical transmission structure using a spring or the like. Therefore, there is a problem that since dislocation from the reference position is caused due to the physical characteristics of the spring itself, such as hysteresis, settling (permanent set in fatigue), or the like, an accurate detection value cannot be obtained. Also in a device using a differential transformer, an accurate detection value can be no longer obtained due to abrasion of slidable contact points and change of voltage thereof at a transformer. This results in not achieving preferred control.

A first object of the present invention is to provide a powder grain processing apparatus capable of obtaining compression moldings made of powder grains and having uniform thickness and hardness.

A second object of the present invention is to provide a powder grain processing apparatus which has a simple structure without necessitating an actuator pressing the seal plates against the compression rollers and which prevents contamination due to oil leakage or the like and abrasion powders from the seal plates, from being mixed therein.

A third object of the present invention is to provide a powder grain processing apparatus in which a housing of the apparatus is sectioned into a process room and a drive room so that the outside of respective component parts such as a hopper, compression rollers, and the like and the inside of the process room can be automatically cleaned.

A fourth object of the present invention is to provide a powder grain processing apparatus capable of adjusting the compression condition of powder grains that are raw material, without making a complicated operation of exchanging screws.

A fifth object of the present invention is to provide a powder grain processing apparatus capable of controlling hardness of compression moldings by recognizing condition of the compression moldings as numerical values on manufacturing lines thereof.

The above-described and other objects and novel features of the present invention will be apparently understood from description of the present specification and the drawings appended hitherto.

DISCLOSURE OF THE INVENTION

Representative aspects of the present invention disclosed in the present application will be briefly summarized as follows.

An apparatus for processing powder grains according to the present invention, having a pair of compression rollers arranged in parallel with each other and supplying powder grains to a powder grain introduction/compression part formed between the compression rollers, thereby forming compressing moldings of the powder grains, includes a seal members being provided to face side surfaces of the compression rollers with clearance maintained from the compression rollers, and forms closer layers of the powder grains between the seal members and side surfaces of the compression rollers when the powder grains enter into the clearance, thereby sealing the powder grain introduction/compression part.

Another apparatus for processing powder grains according to the present invention, having a pair of compression rollers parallel with each other and supplying powder grains between the compression rollers, thereby forming compression moldings of the powder grains, comprises; a pressure detection means for detecting a pressure which the powder grains receive when the powder grains are pressed between the compression rollers; and a control means for adjusting hardness of the powder grains fed from the compression rollers in accordance with the pressure detected by the detection means.

Still another apparatus for processing powder grains according to the present invention, having a pair of compression rollers parallel with each other and supplying powder grains between the compression rollers, thereby forming compression moldings of the powder grains, comprises; a fine change amount detection means for detecting a fine change of a distance between the compression rollers, the fine change being caused by a pressure which the powder grains receive when the powder grains are pressed between the compression rollers; and a control means for adjusting hardness of the powder grains fed from the compression rollers in accordance with a fine change amount of the distance between the compression rollers, the fine change amount being detected by the fine change amount detection means.

In an apparatus for processing powder grains according to the present invention, the control means may adjust a pressure applied to the powder grains.

An apparatus for processing powder grains according to the present invention, having a pair of compression rollers parallel with each other and supplying powder grains between the compression rollers, thereby forming compressing moldings of the powder grains, comprises; a pair of compression roller support shafts for supporting the compression rollers; a compression roller support part for holding the compression roller support shafts; a distortion detection means attached to the compression roller support part and measuring distortion caused at the compression roller support part by a pressure which the compression rollers receive when the powder grains are pressed between the compression rollers; and a control means for adjusting the pressure applied to the powder grains in accordance with a distortion value caused at the compression roller support part, the distortion value being obtained by the distortion detection means.

In an apparatus for processing powder grains according to the present invention, the powder grain processing apparatus further comprises a powder grain press/feed means for feeding the powder grains to the compression rollers, and the control means may control the powder grain press/feed means, thereby adjusting a feed amount of the powder grains. And, the control means may control a rotation speed of the compression roller.

An apparatus for processing powder grains according to the present invention, having a pair of compression rollers parallel with each other and supplying powder grains between the compression rollers, thereby forming compression moldings thereof, comprises; a pitcher hopper provided in a front stage of the compression rollers and storing the powder grains supplied to the compression rollers; and a powder grain press/feed means connected to the pitcher hopper, arranged between the pitcher hopper and the compression rollers, and pressing and feeding the powder grains to the compression rollers, wherein the powder grain press/feed means has a transport tube internally including a screw member for pressing and feeding the powder grains.

In an apparatus for processing powder grains according to the present invention, the transport tube may comprise a deaerating barrel and a deaerating jacket, the deaerating barrel containing the screw member and being made of a member which allows air to pass and does not allow the powder grains to pass, and the deaerating jacket covering the deaerating barrel and being provided with a deaerating vent at a part thereof.

In an apparatus for processing powder grains according to the present invention, the deaerating barrel may be made of porous metal material. And, the hopper may be provided to be movable relatively along the screw member. Moreover, the hopper and the transport tube may be provided to be movable relatively along the screw member. In addition, the screw member may be provided to be able to change a distance between the screw member and the compression rollers.

An apparatus for processing powder grains according to the present invention, having a pair of compression rollers parallel with each other and supplying powder grains between the compression rollers, thereby forming compression moldings of the powder grains, comprises; a powder grain processing room sealing hermetically and containing the compression rollers in a watertight condition; and a cleaning means provided in the powder grain processing room and injecting a cleaning liquid into the powder grain processing room.

In an apparatus for processing powder grains according to the present invention, the cleaning means may be provided at least one of an upper part and side parts of the powder grain processing room.

An apparatus for processing powder grains according to the present invention, having a pair of compression rollers parallel with each other and a powder grain press/feed means for supplying powder grains to the compression rollers, and supplying the powder grains between the compression rollers with use of the powder grain press/feed means, thereby forming compression moldings of the powder grains, comprises; a shearing means provided in a rear stage of the compression rollers and shearing the compression moldings formed by the compression rollers; and a load detection means for detecting a load applied to the shearing means.

In an apparatus for processing powder grains according to the present invention, the apparatus may further comprise a control means for controlling at least one of the powder grain press/feed means and the compression rollers in accordance with data detected by the load detection means. And, the load detection means may detect rotation torque of the shearing means.

Further, the powder grain processing apparatus may be a roller compactor by dry granulating apparatus.

A method for processing powder grains according to the present invention, having a step of supplying powder grains between a pair of compression rollers arranged in parallel with each other, with use of a powder grain press/feed means provided in a front stage of the compression rollers, thereby forming compression moldings of the powder grains, comprises; a step of detecting a load applied to a shearing means during shearing the compression moldings formed by the compression rollers by means of the shearing means provided in a rear stage of the compression rollers; and a step of controlling at least one of the powder grain press/feed means and the compression rollers in accordance with the load detected.

In a method for processing powder grains according to the present invention, the load may be rotation torque for driving the shearing means.

BRIEF DESCRIPTION OF THE DRAWINGS

FIG. 1(*b*) is an explanatory view showing a structure of a dry granulating apparatus which is embodiment 1 of the present invention, and is a side view thereof.

FIG. 2(*b*) is an explanatory view showing a structure of a powder grain processing room in the dry granulating apparatus shown in FIG. 1(*b*), and is a side view thereof.

FIG. 4(*a*) is an explanatory view showing one embodiment of an introduction/compression part shown in FIG. 4 in a greater detail and is an exploded perspective view thereof.

FIG. 5(*b*) is an explanatory view showing a structure of a closer member, and is a front view thereof.

FIG. 5(*c*) is an explanatory view showing a structure of a closer member, and is a base view thereof.

FIG. 11(*b*) is an explanatory view showing a structure of a dry granulating apparatus which is embodiment 2 of the present invention, and is a side view thereof.

FIG. 12(*b*) is an explanatory view showing a structure of a powder grain processing room in the dry granulating apparatus shown in FIG. 11(*b*), and is a side view thereof.

FIG. 14(*b*) is an explanatory view showing a structure of a conventional powder grain processing apparatus, and shows the structure of a seal plates and a metal plate used in the granulation apparatus shown in FIG. 14(*a*).

FIG. 14(*c*) is an explanatory view showing a structure of a conventional powder grain processing apparatus, and shows the relationship between the seal plates and the compression rollers.

BEST MODE FOR CARRYING OUT THE INVENTION

Embodiments of the present invention will be explained below in details on the basis of the drawings.

(Embodiment 1)

Figure 1B:
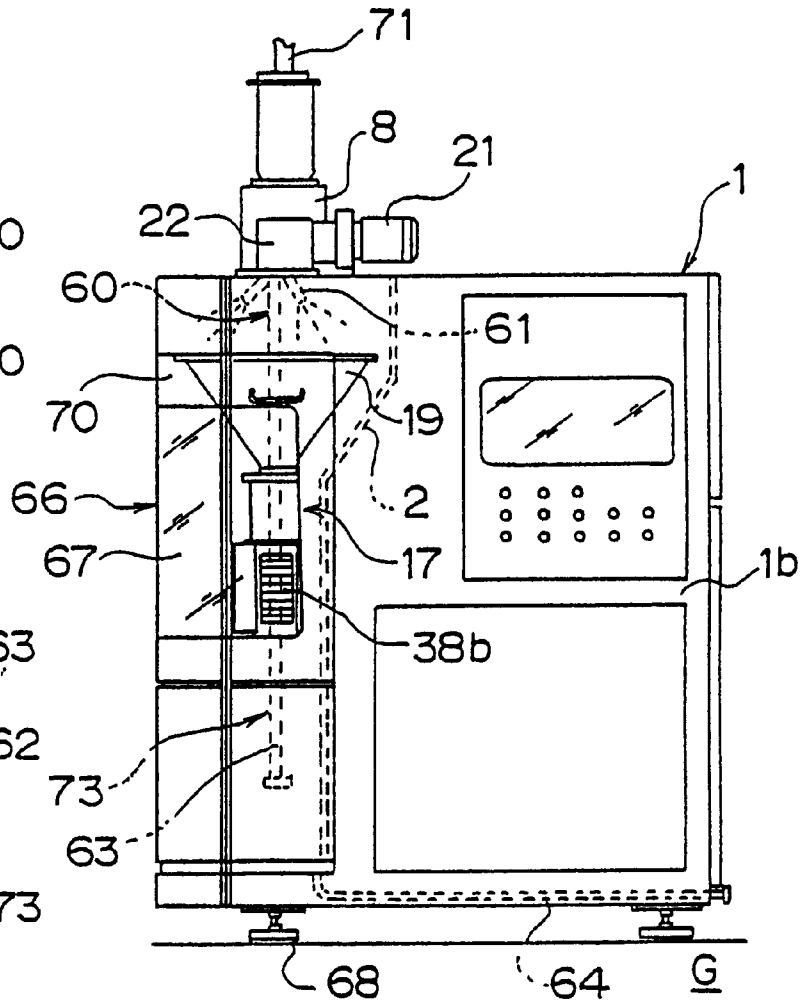
FIG. 1(*a*) is an explanatory view showing a structure of a dry granulating apparatus which is embodiment 1 of the present invention, and is a front view thereof.
Figure 1A:
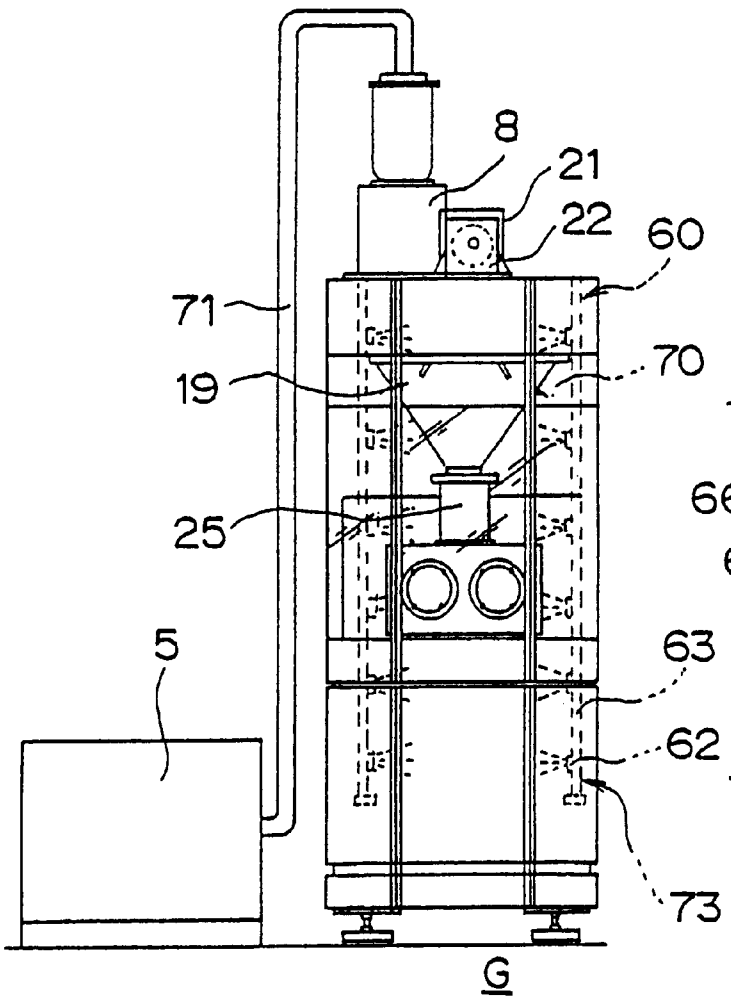
Figures 2A, 2B:
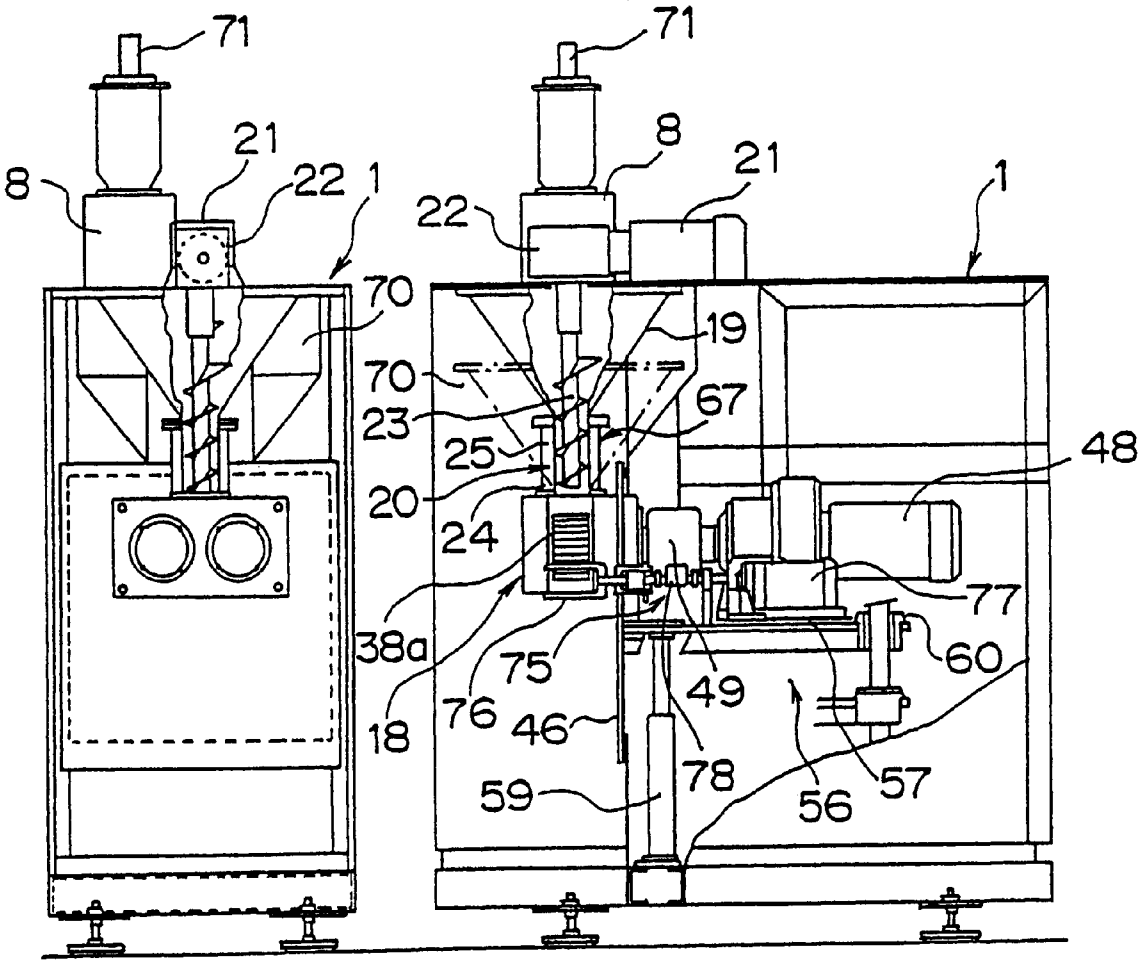
FIG. 2(*a*) is an explanatory view showing a structure of a powder grain processing room in the dry granulating apparatus shown in FIG. 1(*a*), and is a front view thereof.
Figure 3:
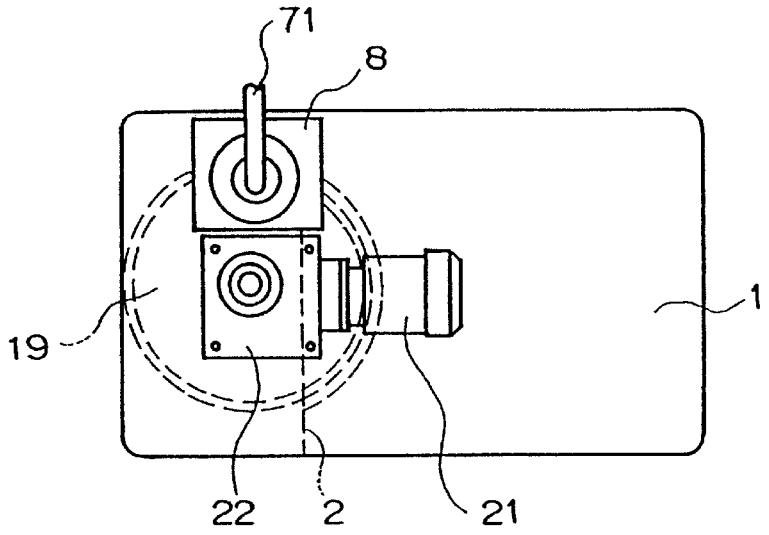
FIG. 3 is a plane view of the dry granulating apparatus shown in FIG. 1(*a*).

FIGS. 1(*a*) and 1(*b*) are explanatory views showing a structure of a dry granulating apparatus (a powder grain processing apparatus) which is embodiment 1 of the present invention. FIG. 1(*a*) is a front view thereof and FIG. 1(*b*) is a side view thereof. And, FIGS. 2(*a*) and 2(*b*) are explanatory views showing a structure inside a powder grain processing room of the dry granulating apparatus shown in FIGS. 1. FIG. 2(*a*) is a front view thereof and FIG. 2(*b*) is a side view thereof. Further, FIG. 3 is a plan view of the dry granulating apparatus shown in FIG. 1.

As shown in FIG. 1, said dry granulating apparatus has a housing 1 set on a floor surface G. The housing 1 is divided, by a partition wall 2, into a powder grain processing room 70 where processing of powder grains is actually carried out, and a drive room 4 where a control operation panel, a motor, and the like are arranged.

In the processing room 70, the powder grains are supplied from a supply hopper 8 provided on an upper portion of the housing 1. The powder grains are fed from a powder grain storage vessel 5 through a hose 71 by vacuum transportation, for example, using an ejector. A powder grain transport means 17 and a compression roller mechanism 18 are provided in the processing room 70. The transport means 17 has a pitcher hopper 19 for receiving and storing the supplied powder grains, and a powder grain press/feed means 20 vertically connected to a lower portion of the hopper 19.

The press/feed means 20 comprises a screw (screw member) 23 and a transport tube 69. The screw 23 is linked through a decelerator 22 to a drive shaft of a motor 21 provided with the top portion of the housing 1. The transport tube 69 comprises a deaerating barrel 24, a deaerating jacket 25 covering outside of the deaerating barrel 24, and a deaerating vent 26 connected to a not shown vacuum suction means provided on the jacket 25. The transport tube 69 need not always be structured to have a deaerating function as described above.

Figure 4A:
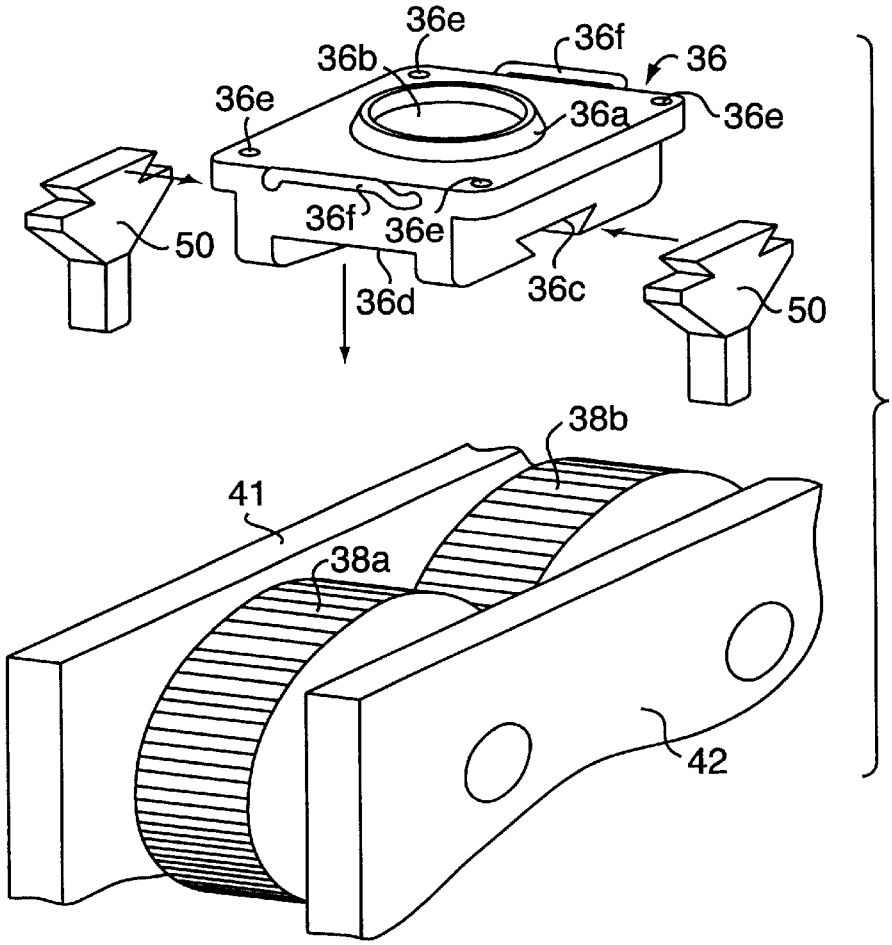
FIG. 4 is an explanatory view showing a structure of the powder grain transport means in the dry granulating apparatus shown in FIG. 1(*a*).
Figure 4:
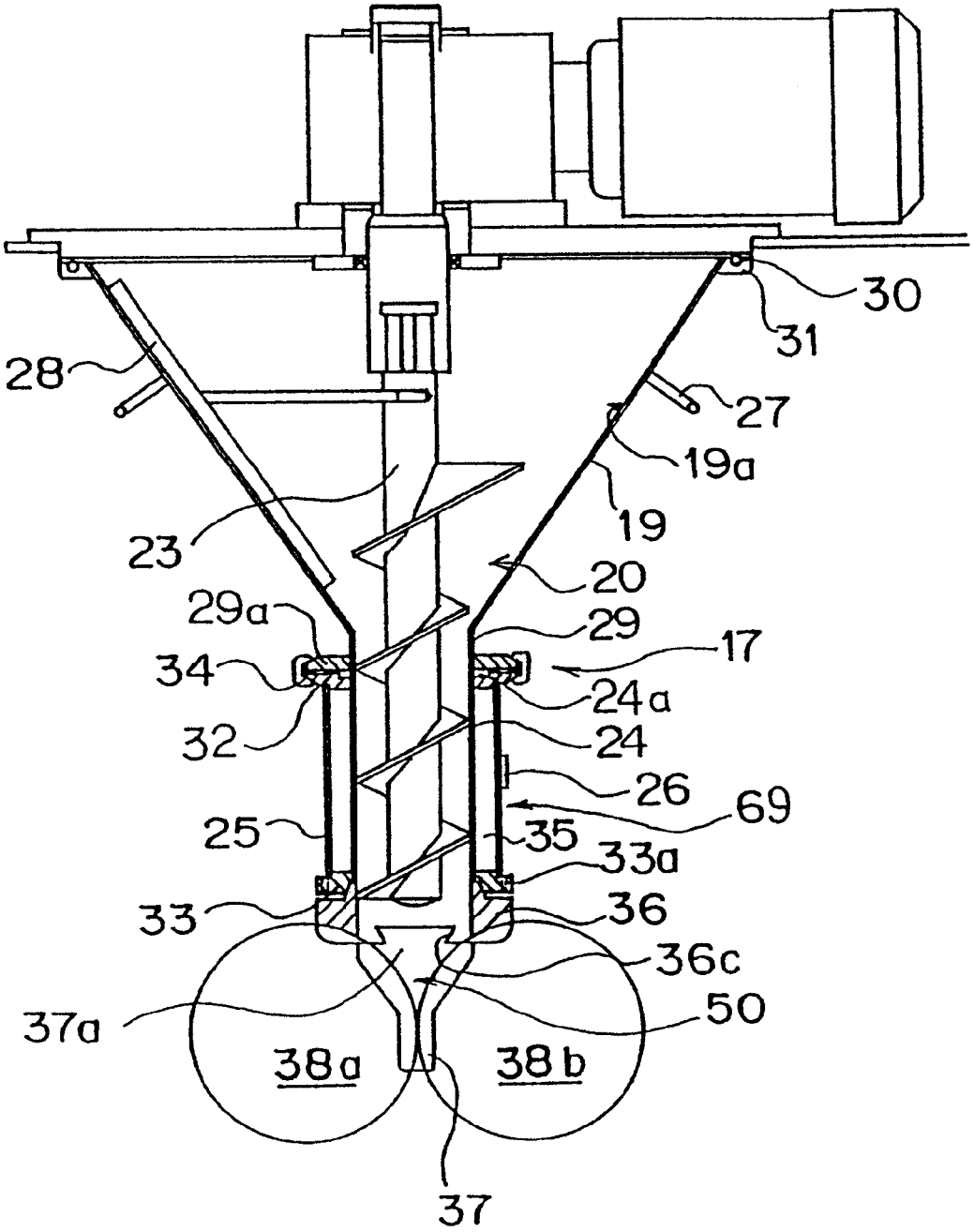

As shown in FIG. 4, the hopper 19 is a container having a funnel-like shape with handles 27 equipped on an outer circumferential surface thereof. The screw 23 is vertically inserted in the hopper 19 along center axis thereof. Inside the hopper 19, a scraper 28 attached to the screw 23 is provided to be rotatable and slidable along an inner circumferential surface 19*a* of the funnel-like shape of the hopper 19. A short tube part 29 is formed on a lower end of a diminishing diameter direction of the hopper 19. A joint flange 29*a* is provided on an outer circumference of the short tube part 29. A brim part 31 fitting in a ring-like packing 30 is welded to an upper surface of the hopper 19.

The deaerating barrel 24 having the same diameter as that of the short tube part 29 is jointed at the lower portion of the short tube part 29. This barrel 24 is made of a member which allows air to pass but does not allows powder grains to pass, for example, porous material such as sintered metal, ceramics, or the like. In addition, a flange part 24*a* is formed on the outer circumference of the barrel 24. Although FIG. 4 shows a structure in which both end surfaces of the short tube part 29 and the barrel 24 are joined to each other, these end surfaces may be coupled by a socket-and-spigot joint to improve adhesion of both end surfaces.

Joint flanges 32 and 33 are welded to upper and lower parts of the deaerating jacket 25, respectively. The joint flange 29*a* of the short tube part 29 is joined to the upper flange 32 so as to put the flange 24*a* between the flange 24*a* of the barrel 24 and the joint flange 29*a*. The flange 32 and the flange 29*a* are fixed by a clamp 34. In this manner, the jacket 25 is fixed integrally and coaxially to a lower part of the hopper 19 so as to contain the barrel 24*a* therein. At this time, such a jacket structure is formed that the jacket 25 is separated by a desirable space from the barrel 24 and covers outside of the barrel 24. So, a deaerating room 35 is formed between the jacket 25 and the barrel 24. And, the deaerating vent 26 is provided so as to communicate with the deaerating chamber 35 and is connected to a vacuum pump not shown.

The flange 33 at a lower part of the jacket 25 is formed in a quadrangular shape, and a closer member 36 is joined to a lower part of the flange 33. A through hole 33*a* for tightening a long screw is formed in the flange 33, and the closer member 36 and the compression roller mechanism 18 are joined to each other by tightening the long screw not shown into the through hole 33*a*.

Figure 5A:
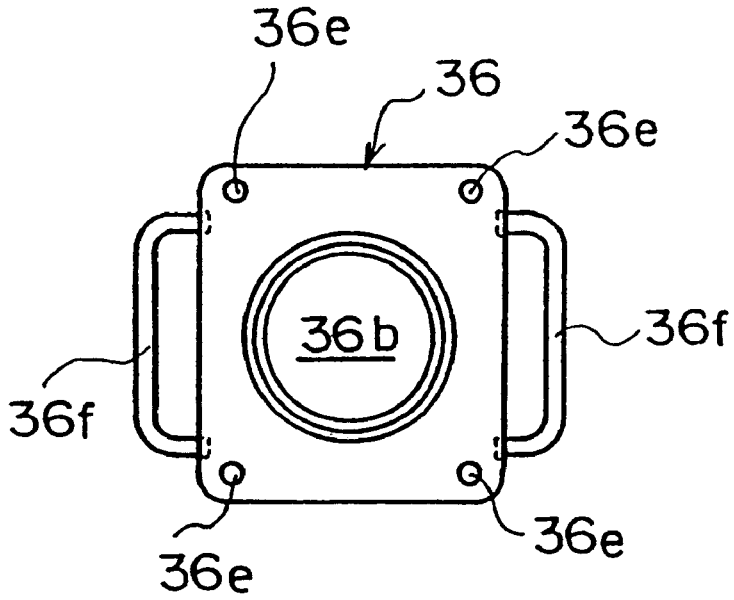
FIG. 5(*a*) is an explanatory view showing a structure of a closer member, and is a plane view thereof.
Figure 5B:
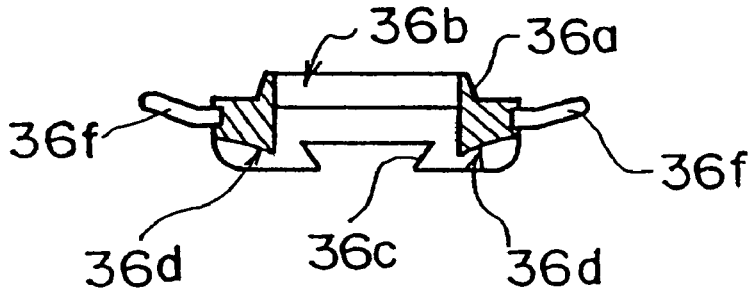
Figure 5C:
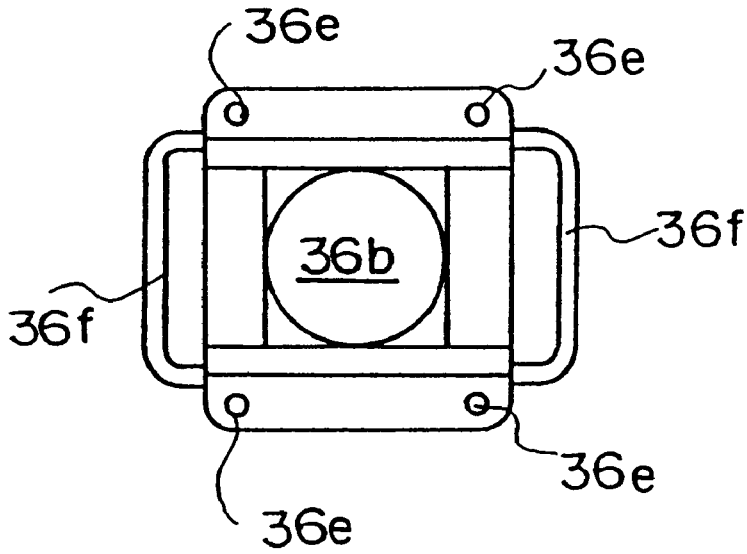

FIGS. 5(*a*) to 5(*c*) are explanatory views showing a structure of the closer member 36. FIG. 5(*a*) is a plan view thereof, FIG. 5(*b*) is a front view thereof, and FIG. 5(*c*) is a base view thereof. As shown in FIG. 5(*a*), the closer member 36 is formed in a quadrangular shape. A convex part 36*a* inserted and joined into the flange 33 of the jacket 25 is integrally formed with a through hole 36*b* having the same diameter as that of the barrel 24. Provided in the lower surface thereof are a dovetail groove 36*c* formed such that a side seal (a seal member) 37 attached to the compression roller mechanism 18 described hereinafter can be inserted, and a clearance parts 36*d* for avoiding interference with the compression rollers 38*a* and 38*b*. Further, through holes 36*e* for tightening long screws inserted into the jacket 25 are provided in the closer member 36, and moreover handles 36*f* are fixed at both sides thereof.

Figure 6:
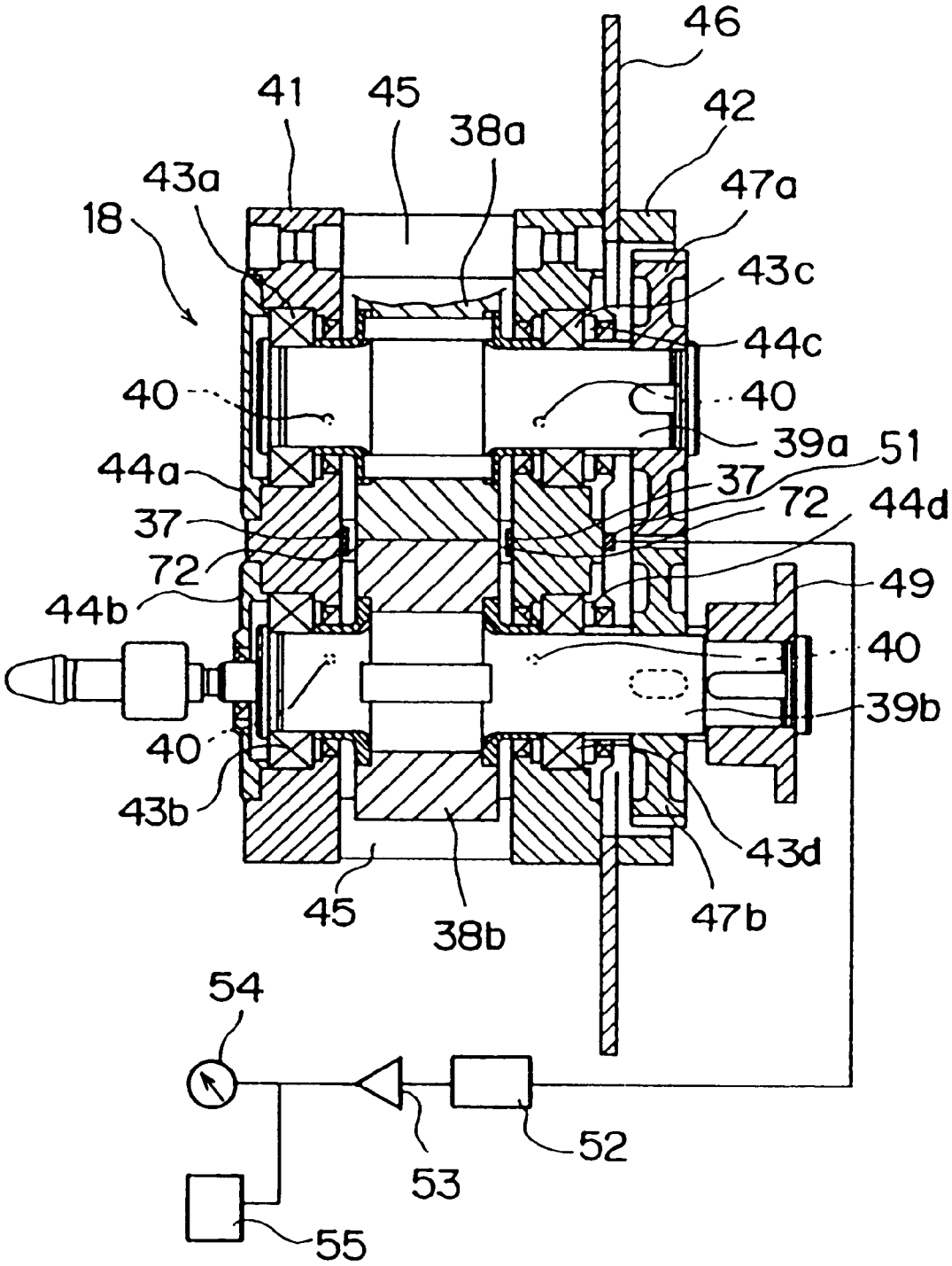
FIG. 6 is an explanatory view showing a structure of a compression roller mechanism.

Next, the compression roller mechanism 18 is fixed to the not shown lower surface of the closer member 36 by the not shown long screws which are inserted into the through holes 33*a* and 36*e* described above. FIG. 6 is an explanatory view showing a structure of the roller mechanism 18. The roller mechanism 18 has a pair of compression rollers 38*a* and 38*b* key-connected to compression roller support shafts 39*a* and 39*b*. And, the powder grains supplied from the powder grain transport means 17 are pressed by these rollers 38*a* and 38*b*.

In the roller mechanism 18, a front frame block (hereinafter abbreviated as a frame) 41 and a rear frame block (hereinafter abbreviated as a frame) 42 are provided. Screw holes 40, which are formed so as to correspond to the through holes 33*a* and 36*e* and to tighten long screws therein, are provided in the frame 41. The frames 41 and 42 are arranged in parallel with a movable wall 46 attached to the partition wall 2. The rollers 38*a* and 38*b* are arranged between the frames 41 and 42 so as to be engaged with each other. Bearings 43*a* to 43*d* are attached to the frames 41 and 42 by bearing stoppers 44*a* to 44*d*. The compression roller support shafts 39*a* and 39*b* are supported on these bearings 43*a* to 43*d*. And, compression roller support parts for holding the shafts 39*a* and 39*b* are formed by the frames 41 and 42, the bearings 43*a* to 43*d*, and the bearing stoppers 44*a* to 44*d*. Further, a tie-rod 45 is provided between the frames 41 and 42 to maintain a distance between frame blocks.

Constant velocity gears 47*a* and 47*b* are attached, respectively, to the pair of shafts 39*a* and 39*b*. The shaft 39*b* is connected to a compression roller drive motor 48 through a coupling 49. Therefore, as the motor 48 is rotated, the roller 38*b* rotates clockwise and the roller 38*a* rotates counterclockwise at constant velocity.

Meanwhile, as shown in FIG. 4, a powder grain introduction/compression part 50 is provided between the rollers 38*a* and 38*b*. In this introduction/compression part 50, the powder grains are supplied from the powder grain transport means 17. Also, as these rollers are rotated, the supplied powder grains are pressed between the rollers 38*a* and 38*b*.

Figure 7:
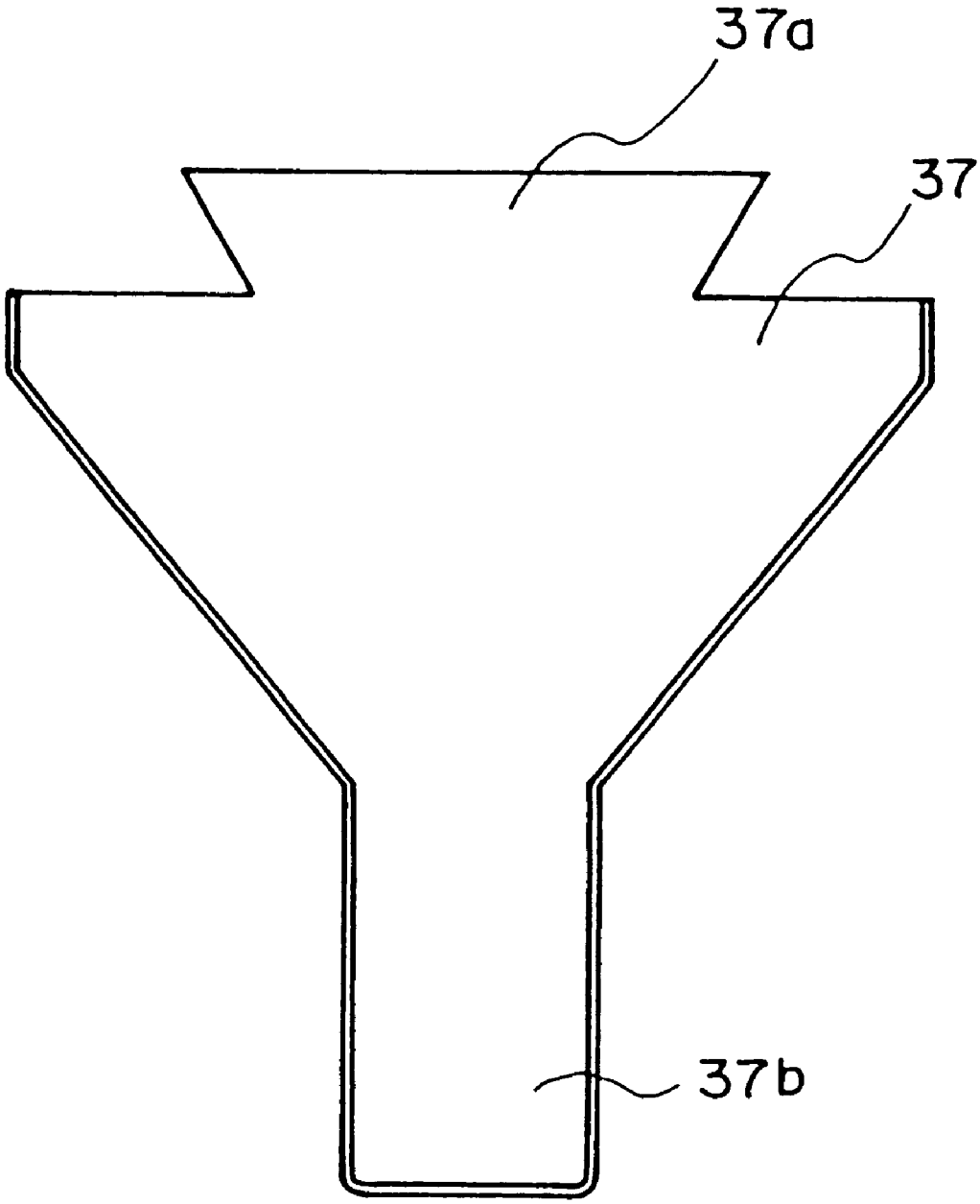
FIG. 7 is an explanatory view showing a structure of side seals.

In the roller mechanism 18 according to the present invention, as shown in FIG. 4, side seals 37 of FIG. 7 are provided on both side surfaces of the rollers 38*a* and 38*b* in order to cover the introduction/compression part 50. FIG. 7 is explanatory view showing a structure of one of these side seals 37. That is, the present apparatus is structured so that the powder grains are prevented from leaking out from the rollers 38*a* and 38*b* by means of providing the side seals 37 between rollers 38*a* and 38*b* and frames 41 and 42, respectively.

Each of the side seals 37 is made of Teflon material as shown in FIG. 7, for example. In an upper portion of respective side seals, a convex part 37*a*, which is slidably engaged with the dovetail groove 36*c* of the closer member 36, is formed. A lower portion of each of the side seals 37 has such a tapered part 37*b* as to correspond to the shape of the introduction/compression part 50. The side seals 37 are inserted between the frame 41 and the roller 38*a* and 38*b*, and between the frame 42 and the roller 38*a* and 38*b*, respectively, so as to have a clearance 72 of about 0.1 to 0.3 mm. In this manner, since the powder grains enter between side seals 37 and each side surface of the rollers 38*a* and 38*b* and a closer layer is formed by the powder grains, the powder grain introduction/compression part 50 is sealed by the layer. FIG. 4(*a*) shows in greater detail one embodiment of the introduction/compression part 50. FIG. 6 shows the clearance 72 emphasized in size, in order to understand easily a relationship between side seals 37 and each of the rollers 38*a* and 38*b*.

Thus, according to the present invention, a closer layer is made of only the powder grains by using the side seals 37, and the introduction/compression part 50 is sealed thereby. Therefore, it is unnecessary to use an actuator or the like such as a hydraulic cylinder for pushing the seal plates, the actuator being used in the conventional powder grain processing apparatus. So, the distance between the frames 41 and 42 can be shorter than that of the conventional apparatus. Accordingly, the shafts 39*a* and 39*b* can be shortened so that rigidity of the roller mechanism 18 itself can be improved.

Also, the introduction/compression part 50 is surrounded by the side seals 37, the pair of rollers 38*a* and 38*b*, and the lower surface of the closer member 36. By this manner, it is possible to obtain a rigid structure capable of withstanding a pressure that is caused when the powder grains pressed and fed by the press/feed means 20, are fed between the rollers 38*a* and 38*b*.

Meanwhile, in the conventional powder grain processing apparatus, one of the rollers 38*a* and 38*b* is pushed by the hydraulic cylinder or the like, in order to prevent such a force from being reduced that the rollers 38*a* and 38*b* press powder grains due to repulsion between the powder grains and the rollers 38*a* and 38*b*. In contrast, in the present dry granulating apparatus, the rollers 38*a* and 38*b* are fixed and the constant distance is maintained between the axes thereof without using an actuator such as a hydraulic cylinder or the like. In the structure like this, the roller mechanism 18 is greatly simplified and contaminations caused by a hydraulic device or the like can be much more prevented, in comparison with the conventional apparatuses. On the other hand, this structure has a risk that the rollers 38*a* and 38*b* may move apart from each other and that a sufficient compression force cannot be obtained at the time of pressing the powder grains if no countermeasure is taken. That is, when the powder grains are supplied to the powder grain introduction/compression part 50 and pressed between the rollers 38*a* and 38*b*, repulsion against a compression force for pressing the powder grains is generated in the rollers 38*a* and 38*b*. Therefore, since each of the rollers 38*a* and 38*b* receives the force in opposite direction of each other, a larger clearance than needed is caused between the rollers and the compression force for pressing the powder grains is reduced.

Hence, in the dry granulating apparatus, a sensor (a distortion detection means) 51 for detecting metal distortion (strain) is adhered to the frame 42, so that the conditions of the rollers 38*a* and 38*b* can be detected in details. That is, if being applied to the rollers 38*a* and 38*b* from the powder grains, repulsion is transmitted to the frames 41 and 42 through the roller support shafts 39*a* and 39*b* as well as the bearings 43*a* to 43*d*. The frame 42 is then distorted by this force. In this case, the distortion of the frame 42 corresponds to the repulsion applied from the powder grains to the rollers 38*a* and 38*b* in the introduction/compression part 50. Accordingly, it is possible to know strength of the force compressing the powder grains by measuring the distortion. And, it is possible to maintain constantly optimal processing conditions by changing operation conditions of the apparatus as based on measured values. That is, if being decreased, the compression force can be recovered by lowering operation speed of the press/feed means 20 to reduce supply amounts of the powder grains or by reducing the rotation speed of the rollers 38*a* and 38*b* or by other methods.

In this case, a metal distortion sensor of an adhesion type that is commercially available is normally used as the sensor 51. This metal distortion sensor is constructed by foil made of copper alloy such as nickel-copper, copper-constantan, or the like and detects a distortion change as a change of a resistance value. As shown in FIG. 6, in the present dry granulating apparatus, the sensor 51 is connected to a distortion detector 52 and to, for example, a pressure gage 54 as an indicator and a control device 55 through a direct current amplifier 53 from the distortion detector 52. In this manner, when the powder grains are fed from the rollers 38*a* and 38*b*, pressure that the rollers 38*a* and 38*b* receive is detected. If the pressure is decreased, the operation conditions for driving the press/feed means 20 and the rollers 38*a* and 38*b* are automatically controlled by the control device 55, so that the compression force is adjusted to a predetermined value. Note that this value being output may be used as an alarm buzzer. And, reduction of the pressure force or a withstand pressure limit value may be informed to an operator, so that the operator can manually control the operation conditions.

Figure 8A:
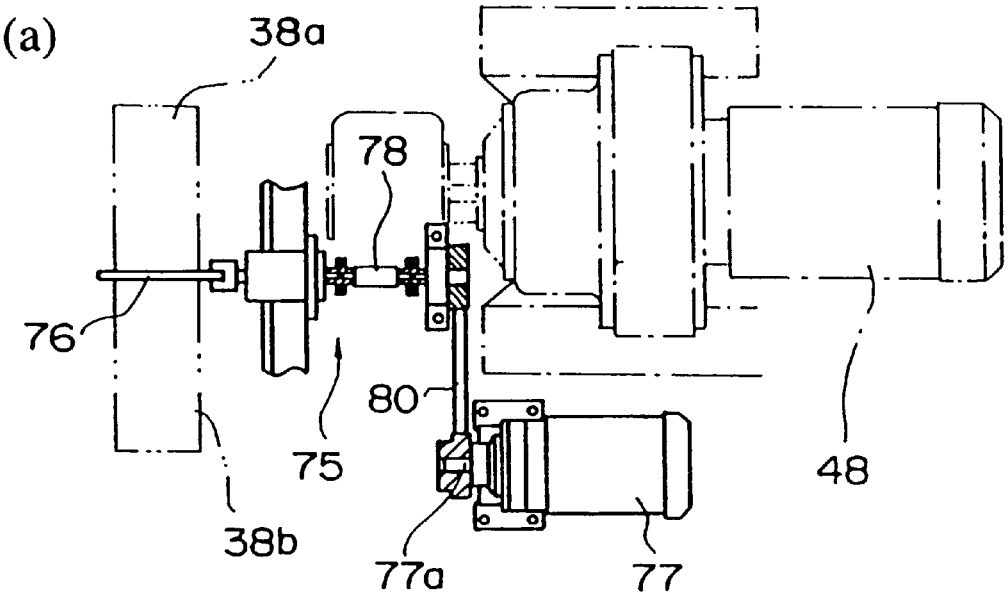
FIGS. 8(*a*) and 8(*b*) are explanatory views showing a structure of a shearing device, FIG. 8(*a*) is a plan view thereof, and FIG. 8(*b*) is a front view thereof.
Figure 8B:
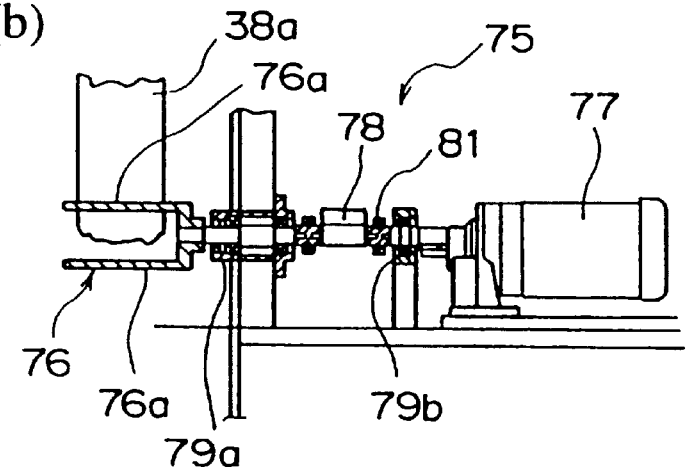

Meanwhile, a shearing device (shearing means) 75 is provided below the compression roller mechanism 18, as shown in FIG. 2. This shearing device 75 shears sheet-like or flake-like compression moldings W pressed by the roller mechanism 18, and measures hardness of the compression moldings W by a torque sensor described later. FIGS. 8(*a*) and 8(*b*) are explanatory views shown a structure of this shearing device 75. FIG. 8(*a*) is a plan view thereof, and FIG. 8(*b*) is a front view thereof.

The shearing device 75 comprises a shearing member 76 for shearing compression moldings W squeezed out from the rollers 38*a* and 38*b*, a shearing member drive motor 77 (hereinafter abbreviated as a motor 77) used as a rotation drive source for rotating the shearing member 76, and a torque sensor (a load detection means) 78 for measuring a load when the shearing member 76 is rotated. In this case, the shearing member 76 is formed in a tuning-folk-like shape having two arms 76*a*, and is located and installed below the introduction/compression part 50 of the rollers 38*a* and 38*b*. And, the arms 76*a* are rotated by the motor 77, thereby shearing and smashing the compression moldings W squeezed out from the rollers 38*a* and 38*b*.

The motor 77 is provided on a slider 60 of an elevation mechanism 56 described below adjacent to the motor 48. And, a sensor shaft 81 of the torque sensor 78 is rotated through a belt 80 driven by the drive shaft 77*a* of the motor 77. The sensor shaft 81 of the sensor 78 links the shearing member 76 and the motor 77 to each other. And, load caused by rotation of the shearing member 76, is converted into an electric signal and then is output. The shearing member 76 and the sensor 78 are supported by bearings 79*a* and 79*b* mounted on a motor base 57 of the elevation mechanism 56. For the structure like this, the sensor 78 can exactly measure fragility of the compression moldings W without affected by the shearing operation of the shearing member 76.

Figure 9:
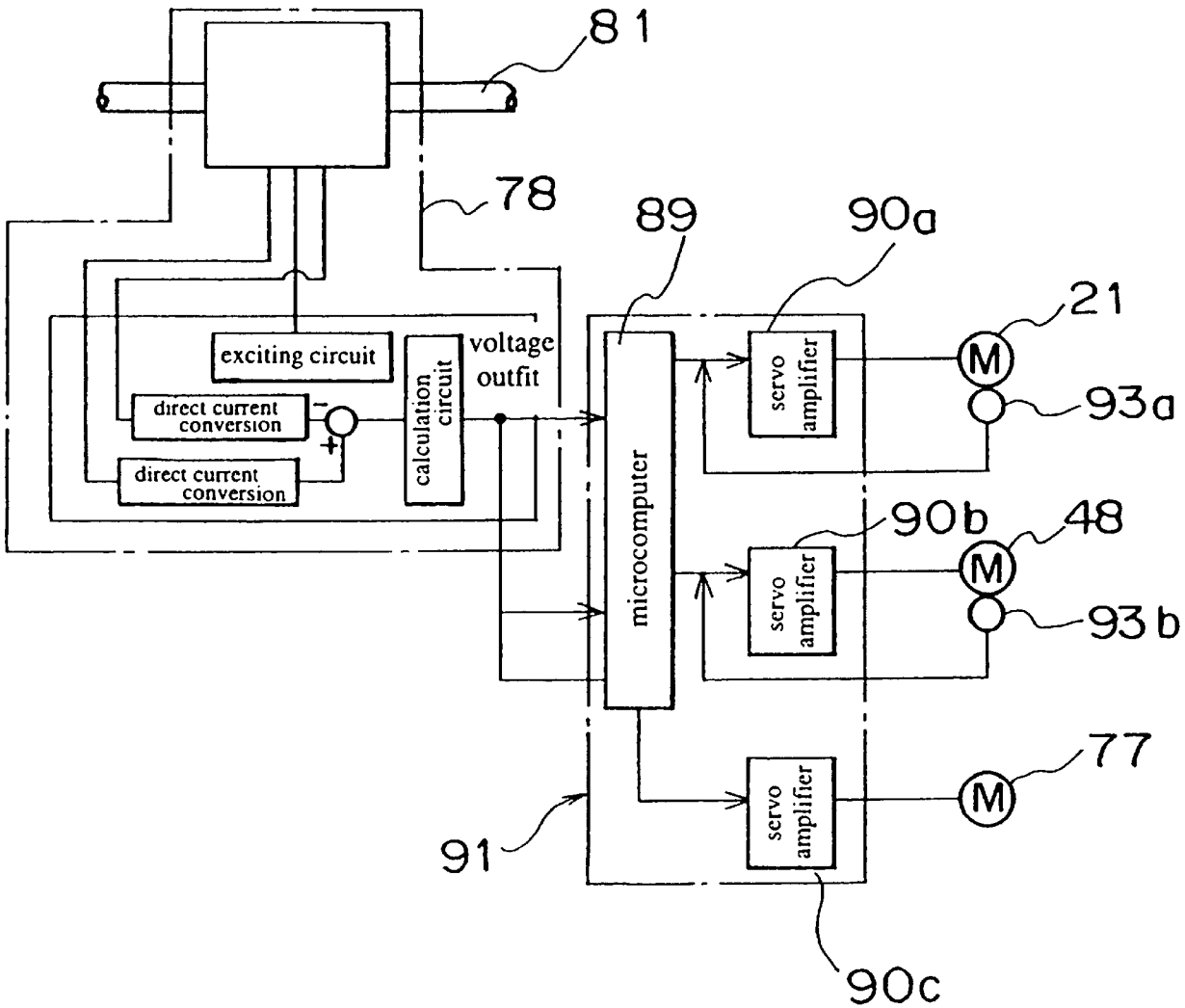
FIG. 9 is a block diagram showing a structure of a control circuit associated with the shearing device.

A commercially available sensor is used as the torque sensor 78. When a torque is applied to the sensor shaft 81, the sensor 78 outputs a voltage proportional to the torque. FIG. 9 is a block diagram showing a structure of a control circuit associated with the shearing device 75. As shown in FIG. 9, a detection value obtained from the sensor 78 is output to a control part (control means) 91 comprising a microcomputer 89 and servo amplifiers 90*a* to 90*c*. And, rotation control signals are output from the control part 91 to the motor 21 of the press/feed means 20 or the motor 48 of the rollers 38*a* and 38*b*.

The control part 91 has the microcomputer 89 which processes the rotation control signals for indicating the rotation speed of the motors 21 and 48 on the basis of the voltage being output from the sensor 78. The control part 91 also has servo amplifiers 90*a* and 90*b* for driving motors 21 and 48, respectively, on the basis of the rotation control signals formed by and output from the microcomputer 89, and signals from tachometer generator 93*a* and 93*b*. And, the control part 91 controls rotation of the rollers 38*a* and 38*b* and the press/feed means 20 by the microcomputer 89 and servo amplifiers 90*a* and 90*b*, respectively. That is, if the torque for rotating the shearing member 76 is increased, it is determined that the compression moldings W become hard (a high density). In accordance with this determination, the rotation speeds of the rollers 38*a* and 38*b* and the press/feed means 20 are controlled to lower density of the compression moldings W. On the other hand, if the torque is decreased, it is determined that the compression moldings become low density, and then the rotation speeds of the rollers 38*a* and 38*b* and the press/feed means 20 are controlled. Note that condition of the compression moldings W may be controlled by either the rollers 38*a* and 38*b* or the press/feed means 20, or by both.

Thus, in the present dry granulating apparatus, the sensor 78 of the shearing device 75 can detect hardness, fragility, and the like of the compression moldings W at any time, and control the press/feed means 20 and the rollers 38*a* and 38*b* on the basis of the detected data. In addition, the shearing member 76 can also be driven in compliance with the squeezing speed of the compression moldings W, so that the shearing device 75 can be driven under an optimal condition which complies with the fragility or the like of the compression moldings W. By this way, the compression moldings W can be obtained which become uniform in the fragility or the like, so that it is possible to achieve stabilized quality of granular productions by whole graining them.

Figure 10:
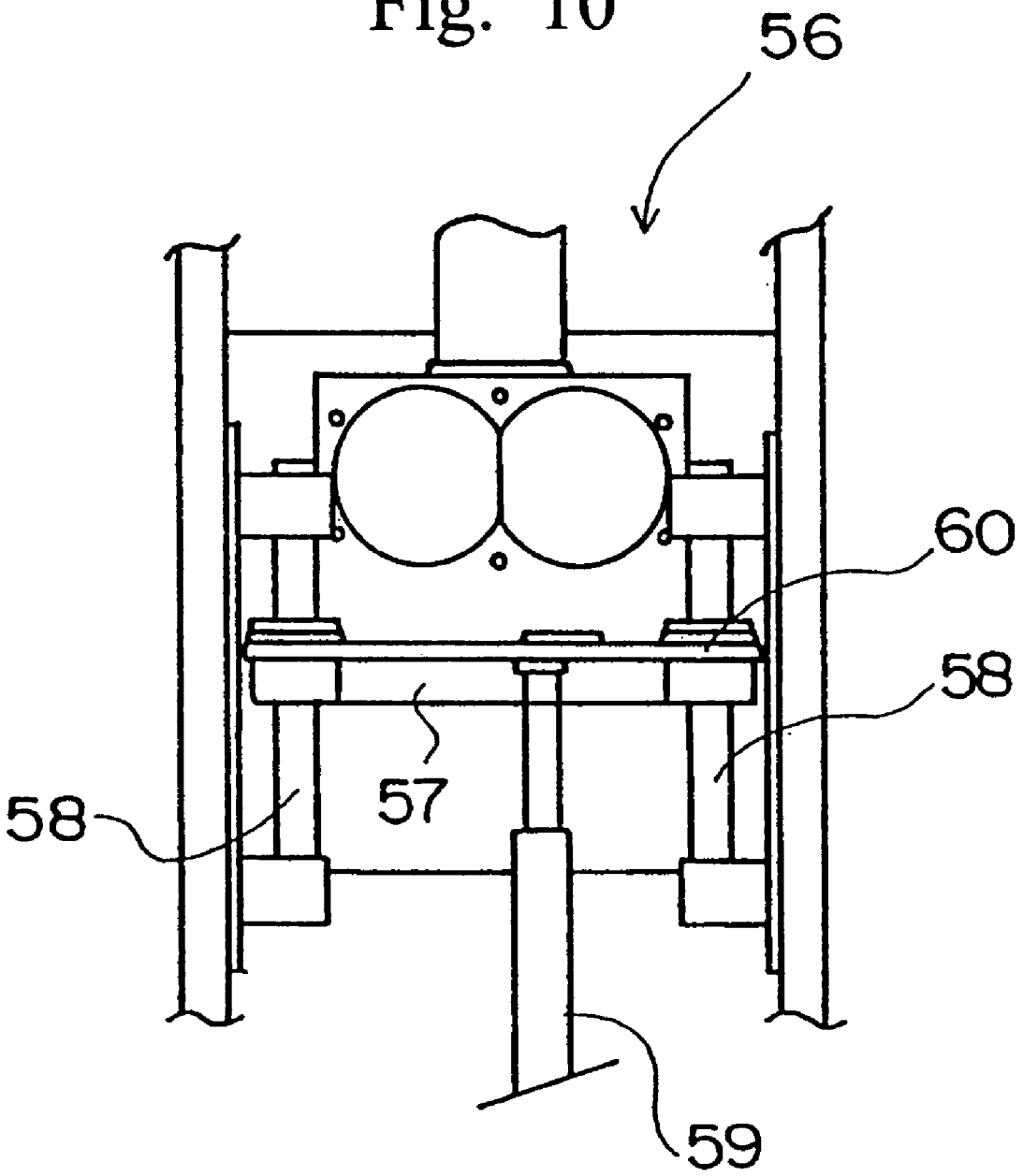
FIG. 10 is an explanatory view showing a structure of an elevation device.

The compression roller drive motor 48 is mounted on the motor base 57 provided in the processing room 70 such that the base 57 can freely move up and down. FIG. 10 is an explanatory view showing a structure of the elevation mechanism 56. The base 57 is fixed to the movable wall 46, as shown in FIG. 2(*b*). Also, the compression roller mechanism 18, integrally connected to the hopper 19, the jacket 25, and the closer member 36, is fixed at the movable wall 46. Accordingly, the roller mechanism 18 and the like are integrally moved up and down in the processing room 70 as the base 57 moves up and down.

The elevation mechanism 56, moving the base 57 up and down, comprises guides 58 and 58 fixed at both inner side surfaces of the housing 1, a hydraulic cylinder 59, and the slider 60 moved up and down along the guide 58 by the cylinder 59, as shown in FIG. 10. Therefore, as the cylinder 59 is operated, the base 57 moves up and down so that the roller mechanism 18 and the hopper 19, set on the movable wall 46, move up and down in the processing room 70. FIG. 2(*b*) shows an elevation state of the hopper 19, and the hopper 19 can move between positions indicated by both solid line and one chain line.

In the present dry granulating apparatus, a distance between one end part of the screw 23 and the rollers 38*a* and 38*b* can be appropriately changed by the elevation mechanism 56. Accordingly, for example, in case of powder grains which cohere for the feed force caused by rotation of the screw 23 in the presence of the rollers 38*a* and 38*b*, the distance is set to enlarge, so that the cohesion is prevented beforehand. Conventionally, a length of the screw 23 is changed to prevent the cohesion. Therefore, by preparing various screws having different lengths, such screws are properly exchanged in accordance with kinds of powder grains, respectively. However, in the dry granulating apparatus according to the present invention, only one screw can be widely applied to various kinds of powder grains because the screw 23 is fixed at the movable hopper 19. Accordingly, replacement services and kinds of screw can be reduced.

In addition, positional relationship between the screw 23 and the hopper 19 can be appropriately changed as shown in FIG. 2(*b*), since the screw 23 in the press/feed means 20 is fixed at the housing 1. That is, a length of the screw 23 entering into the barrel 24 can be appropriately adjusted, so that the press/feed means 20 can change a distance feeding the powder grains. Accordingly, compressing condition of the screw 23 can be appropriately changed depending on kinds of powder grains. In this case, it is also unnecessary to prepare various kinds of screw 23 in accordance with the kinds of powder grains.

Further, a cleaning device (a cleaning means) 73 for cleaning inside of the processing room 70, the hopper 19, and the roller mechanism 18 is provided in the processing room 70. The cleaning device 73 comprises cleaning nozzles 61 and cleaning nozzles 62. The cleaning nozzles 61 are provided on the inner circumferential surface of the hopper 19 with an appropriate distance maintained therefrom and inject a cleaning liquid to the inner surface of the hopper 19. And the cleaning nozzles 62 are arrested at an appropriate portion of the inner wall surface of the processing room 70, respectively. The nozzles 62 are attached to cleaning tubes 63 provided and extended vertically in the processing room 70. The cleaning tubes 63 and the nozzles 61 are connected to a cleaning liquid supply pump not shown. In addition, a drain tube 64 for draining the cleaning liquid after finishing the cleaning is provided on a bottom surface of the processing room 70.

The inside of the processing room 70 is watertight so that the cleaning liquid might not leak to the outside thereof during cleaning. Therefore, a seal member 65 is adhered to an edge of an opening portion 2*a* formed in the partition wall 2 in order to connect the roller mechanism 18 with the motor 48. And, the processing room 70 and the drive room 4 maintain a sealed watertight condition by installing the movable wall 46 which moves slidably on the seal 65 with watertight contact maintained therebetween.

A door 66 which can be opened and closed with respect to the housing 1 is provided at a front surface part of the processing room 70. Also, a transparent window 67 is fitted in the door 66 so that the inside of the processing room 70 can be observed from the outside. Further, vibration isolation bases 68 are provided between the housing 1 and the floor surface G, thereby supporting the dry granulating apparatus while preventing vibrations.

Next explanation will be made of granulation operation in the dry granulating apparatus having the structure as described above. At first, in the present dry granulating apparatus, raw powder grains are vacuum-transported from the storage vessel 5 through a hose 71 to the hopper 8. The powder grains supplied to the hopper 8 have a high specific volume and a high bulk density. The powder grains supplied to the hopper 8 are thrown into the hopper 19.

When the hopper 19 is at a moved-up position thereof, the packing 30 of the top part thereof has a tight contact with a back surface of a top board of the housing 1. Supply of powder grains into the hopper 19 is carried out by a down move of the hopper 19. Then, the hopper 19 is moved up, and the inside of the hopper 19 is kept on closed condition. Accordingly, the powder grains supplied into the hopper 19 are stored in the hopper 19 without scattering or leaking to the outside of the hopper 19. The top part of the hopper 19 is provided so as to be able to move up and down from a position of abutting on a back surface of the housing 1, to a position down from the position due to the elevation mechanism 56. Therefore, it is possible to throw manually different kinds of powder grains in a clearance gap opened in the upper part of the hopper 19 by moving down the hopper 19.

Next, the powder grains in the hopper 19 are fed to the roller mechanism 18 through the transport means 17. That is, the powder grains are fed downward from the hopper 19 by the screw 23 of the press/feed means 20. At this time, since the scraper 28 is rotated in accordance with rotation of the screw 23, the powder grains in the hopper 19 are transported into the transport tube 69 by both self-weight of the powder grains and rotation of the screw 23.

Since the transport tube 69 communicates with the short tube part 29 of the hopper 19, the powder grains are supplied into the barrel 24 of the short tube part 29 through the short tube part 29. In this case, the barrel 24 is made of a permeable member and the jacket 25 connected to a vacuum pump not shown is provided around the barrel. In addition, the closer member 36 and the roller mechanism 18 are provided under the jacket 25. Accordingly, the powder grains in the barrel 24 pressed and fed under a negative pressure by the screw 23 in such a state that flow of the powder grains is temporarily stored and squeezed by the closer member 36 and the roller mechanism 18. Therefore, the powder grains are pressed in the barrel 24 and then air included in the barrel 24 is deaerated outward. And, the air, included in the powder grains, passes from micro holes of the barrel 24 through the deaerating room 35 to the deaerating port 26 of the jacket 25 and is forced to vacuum-suck from the deaerating port 26.

The powder grains pressed and fed by the press/feed means 20 are supplied to the introduction/compression part 50 formed between the rollers 38*a* and 38*b*. Since the rollers 38*a* and 38*b* rotate in the inward direction so as to be engaged with each other, the powder grains are put therebetween, fed out, and pressed at a high density. At this time, the side seals 37 of the roller mechanism 18 are slightly slid in the dovetail groove 36*c* of the closer member 36 due to the compression force of the powder grains, the compressing force being caused by the press/feed means 20. So, the clearance 72 of about 0.1 to 0.3 mm is formed between both side surfaces of the rollers 38*a* and 38*b* and the side seals 37. Further, the powder grains enter into the clearance 72 of about 0.1 to 0.3 mm thereby forming cross-bridges between both side surfaces of the rollers 38*a* and 38*b* and the side seals 37. In this manner, it is possible to prevent the powder grains from leaking to the outside from the rollers 38*a* and 38*b*. Also, since the rollers 38*a* and 38*b* do not contact the side seals 37, abrasion powders of the side seals 37 or the rollers 38*a* and 38*b* is not mixed into the powder grains. Further, heat is not generated by friction between the rollers 38*a* and 38*b* and the side seals 37, and the product quality can be stabilized.

In addition, when the rollers 38*a* and 38*b* receive the repulsion due to the compression force to the powder grains, the repulsion is transmitted to the frames 41 and 42 through the shafts 39*a* and 39*b* and the bearings 43*a* to 43*d*. The frame 42 is distorted by this repulsion. In the present dry granulating apparatus, the sensor 51 is adhered to the frame 42 to detect condition of the rollers 38*a* and 38*b* when the powder grains are pressed. That is, the distortion of the frame 42 changes the resistance balance of the sensor 51, and this change is detected as a voltage difference by the distortion detector 52. And, this voltage difference is transmitted to the pressure gage 54 and the control device 55 through the direct current amplifier 53. Accordingly, the granulate-grain-size distribution of flake-like compression moldings fed from the rollers 38*a* and 38*b* can be determined by visually monitoring the numerical value of this pressure gage 54. In addition, data obtained by A/D-converting the detected voltage difference, is supplied to the control device 55, and each rotation speed of the motors 21 and 48 is controlled on the basis of the data, and then it is possible to obtain compression moldings having the preferable granulate-grain-size distribution.

The compression moldings W fed from the rollers 38*a* and 38*b* are sheared by the shearing member 76 provided under the shearing device 75. In this case, the rotation torque of the shearing member 76 is detected by the sensor 78, and the control part 91 controls the rotation speeds of the motors 21 and 48 on the basis of the detection data. Accordingly, the condition of the compression moldings W can be grasped on real time in the present dry granulating apparatus. And, the rotations of the press/feed means 20 and the rollers 38*a* and 38*b* are controlled so that the compression moldings having optimal hardness and fragility can be obtained constantly. Note that, after the powder grains are sheared by the shearing device 75, the sheared powder grains are supplied to the grain refiner not shown and then granulate products are obtained.

Meanwhile, the processing room 70 is cleaned by the cleaning device 73 after the steps of granulating desired granular products are completed. In this case, in the present dry granulating apparatus, the hopper 19 is firstly moved up by the elevation mechanism 19 and is cleaned in a state where its top part is kept in contact with the back surface of the housing 1. At this time, the processing room 70 is kept sealed. In this condition, the inner surface of the hopper 19, the barrel 24, the closer member 36, the side seals 37 of the roller mechanism 18, and the rollers 38*a* and 38*b* of the roller mechanism 18 are cleaned by the nozzle 61. Next, the hopper 19, the jacket 25, the closer member 36, and the roller mechanism 18 are moved down by the elevation mechanism 56. These components are cleaned from the outside thereof by the nozzle 62 and the inside of the processing room 70 is cleaned. Thus, in the dry granulating apparatus according to the present invention, the respective component parts need not be disassembled for cleaning, unlike the conventional apparatuses. Therefore, the number of steps required for disassembling and cleaning this apparatus can be greatly reduced.

The barrel 24 and the jacket 25 can be appropriately replaced with other ones that have a different length size, a different pore roughness, and the like depending on the kind of powder grains. And, the service for replacing the barrel 24 and the jacket 25 is carried out as follows; That is, the hopper 19 is firstly moved down by the elevation mechanism 56 to detach the screw 23 from the barrel 24. Next, the clamp 34 coupling the flange 29*a* of the short tube part 29 and the flange 32 of the barrel 24 with each other is removed. In addition, the long screws screwed into the frames 41 and 42 through the through holes 33*a* in the flange 33 is loosened and pulled off from the through holes 33*a*, respectively. In this state, the jacket 25 together with the barrel 24 is pulled out. Further, a barrel and a jacket that have different specifications are set under the flange 29*a* and are installed between the hopper 19 and the closer member 36 with use of the long screws and the clamp 34. Thereafter, the long screws are screwed into the frames 41 and 42 and fixed thereto, respectively, and the service for replacing the barrel 24 and the jacket 25 with each other is thus completed.

(Embodiment 2)

Figure 11:
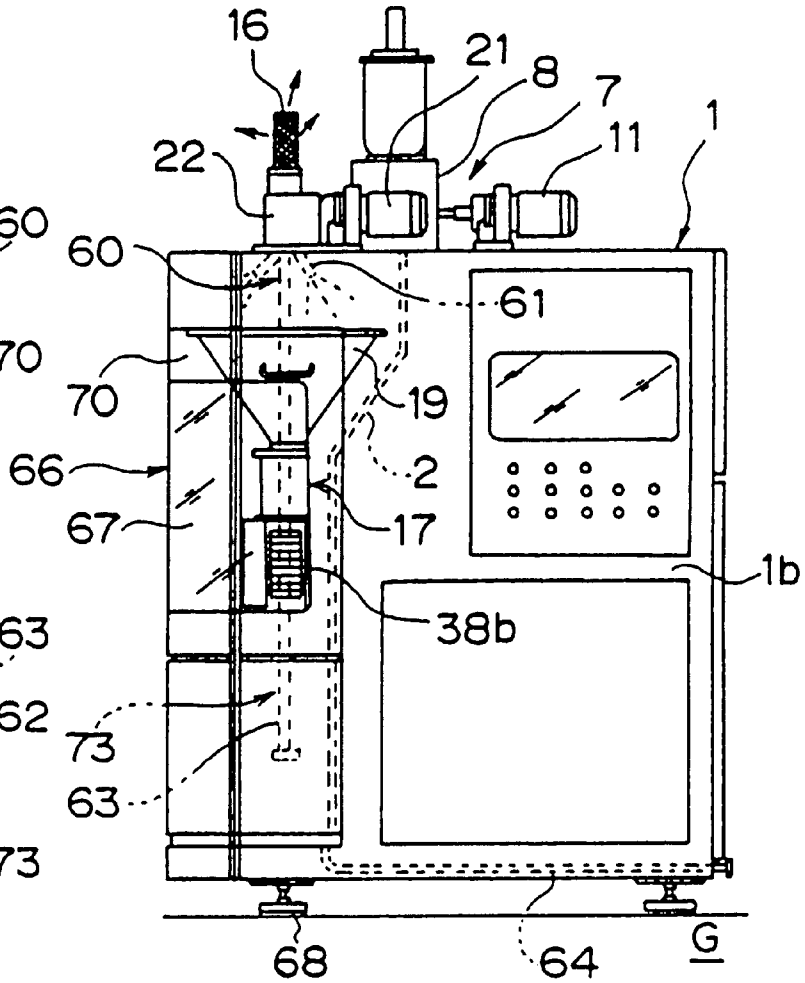
FIG. 11(*a*) is an explanatory view showing a structure of a dry granulating apparatus which is embodiment 2 of the present invention, and is a front view thereof.
Figure 11A:
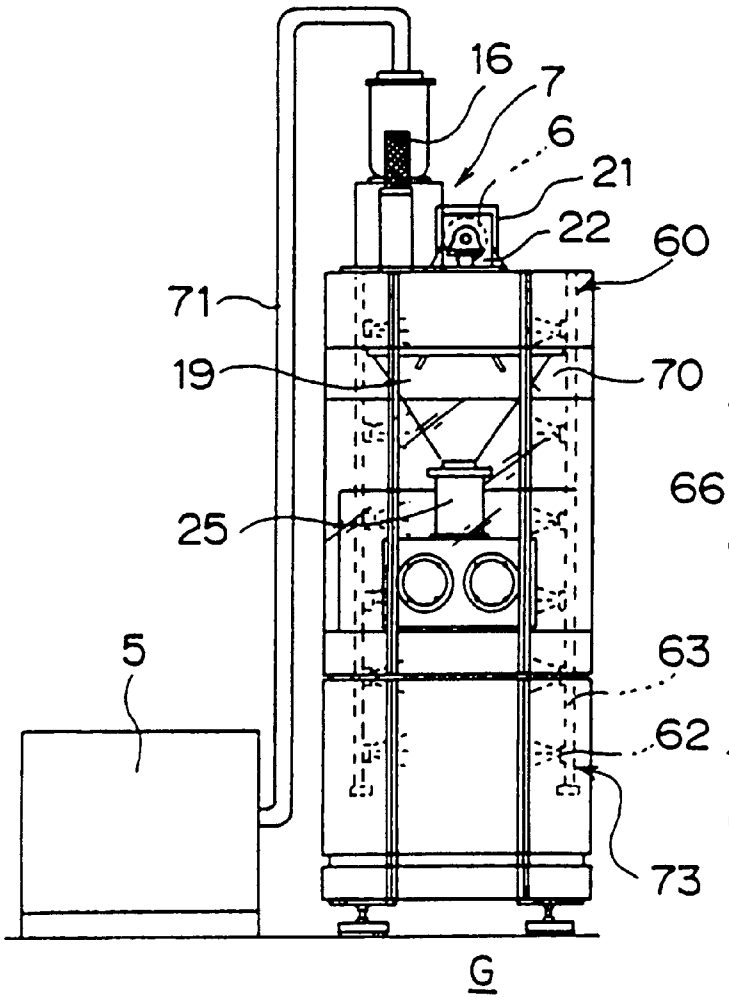
Figures 12A, 12B:
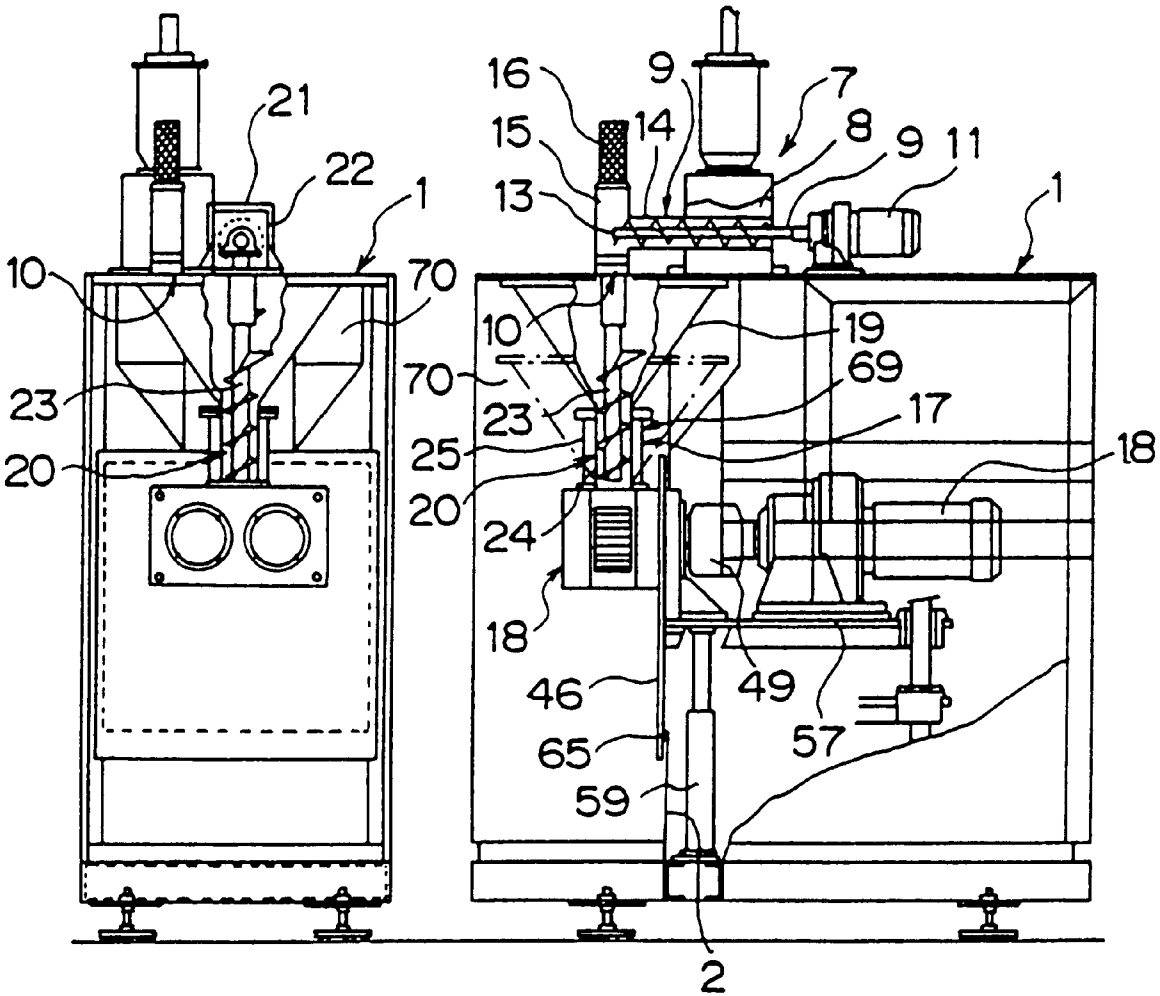
FIG. 12(*a*) is an explanatory view showing a structure of a powder grain processing room in the dry granulating apparatus shown in FIG. 11(*a*), and is a front view thereof.
Figure 13:
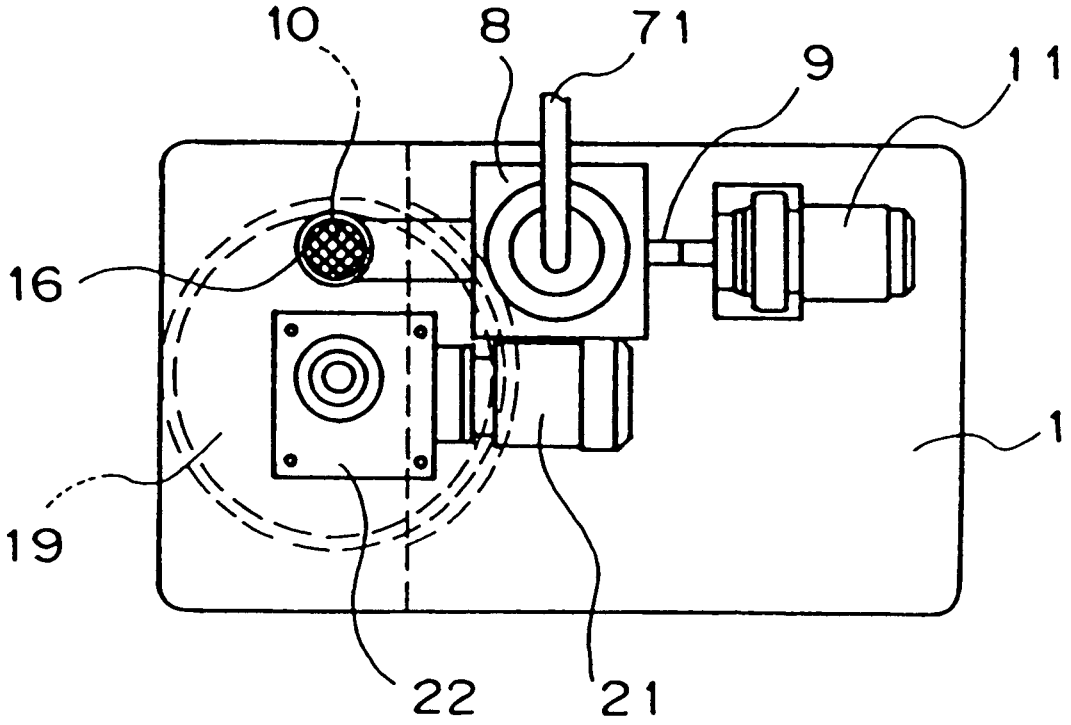
FIG. 13 is a plane view of the dry granulating apparatus shown in FIG. 9.
Figure 14A:
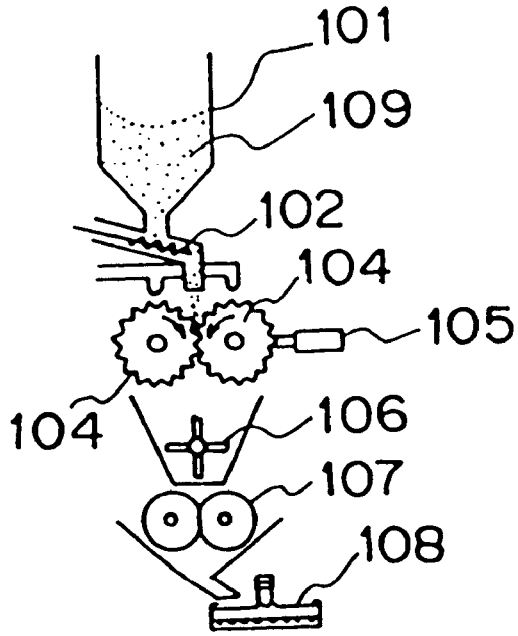
FIG. 14(*a*) is an explanatory view showing a structure of a conventional powder grain processing apparatus, and shows the entire structure thereof.
Figure 14B:
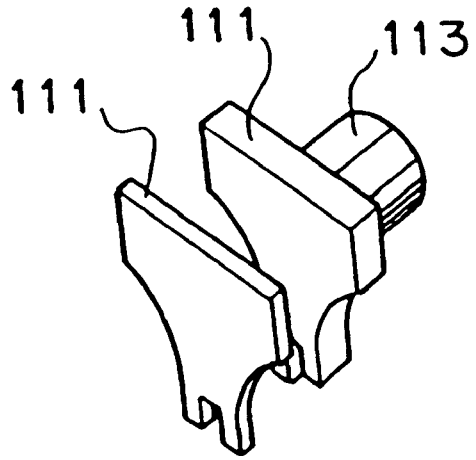
Figure 14C:
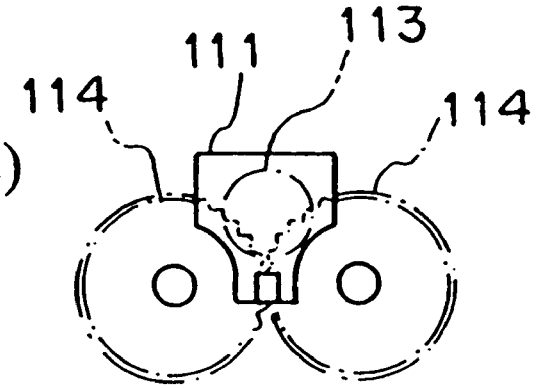
Figure 15:
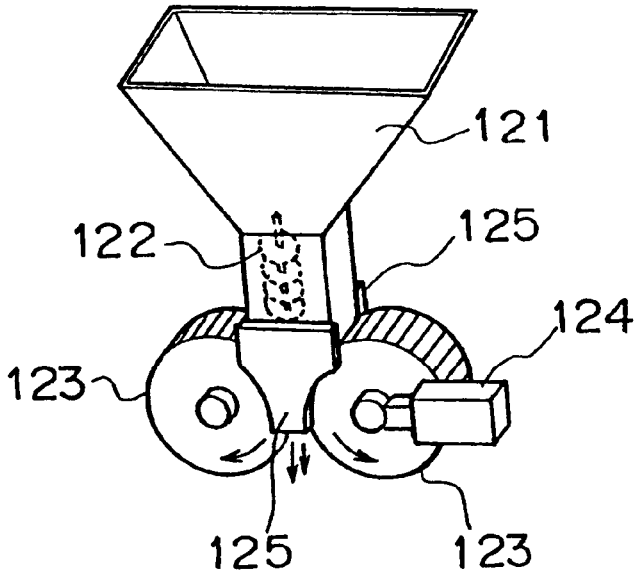
FIG. 15 is an explanatory view showing a structure of another conventional processing apparatus.
Figure 16:
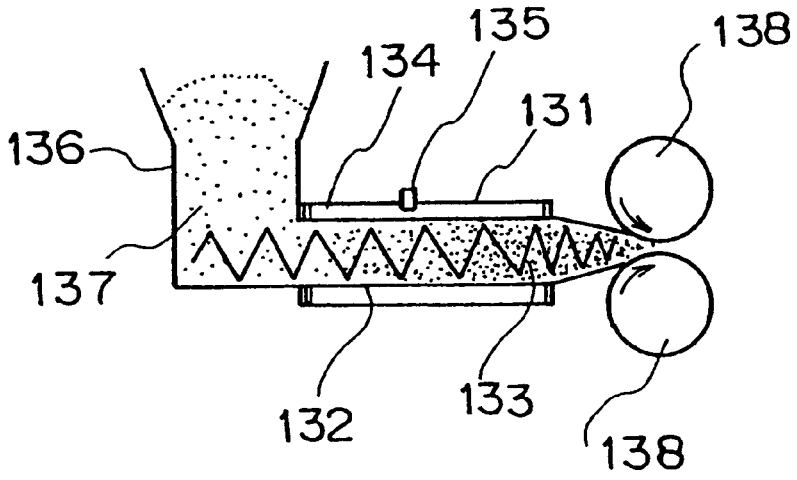
FIG. 16 is an explanatory view showing a structure of another conventional processing apparatus.
Figure 17:
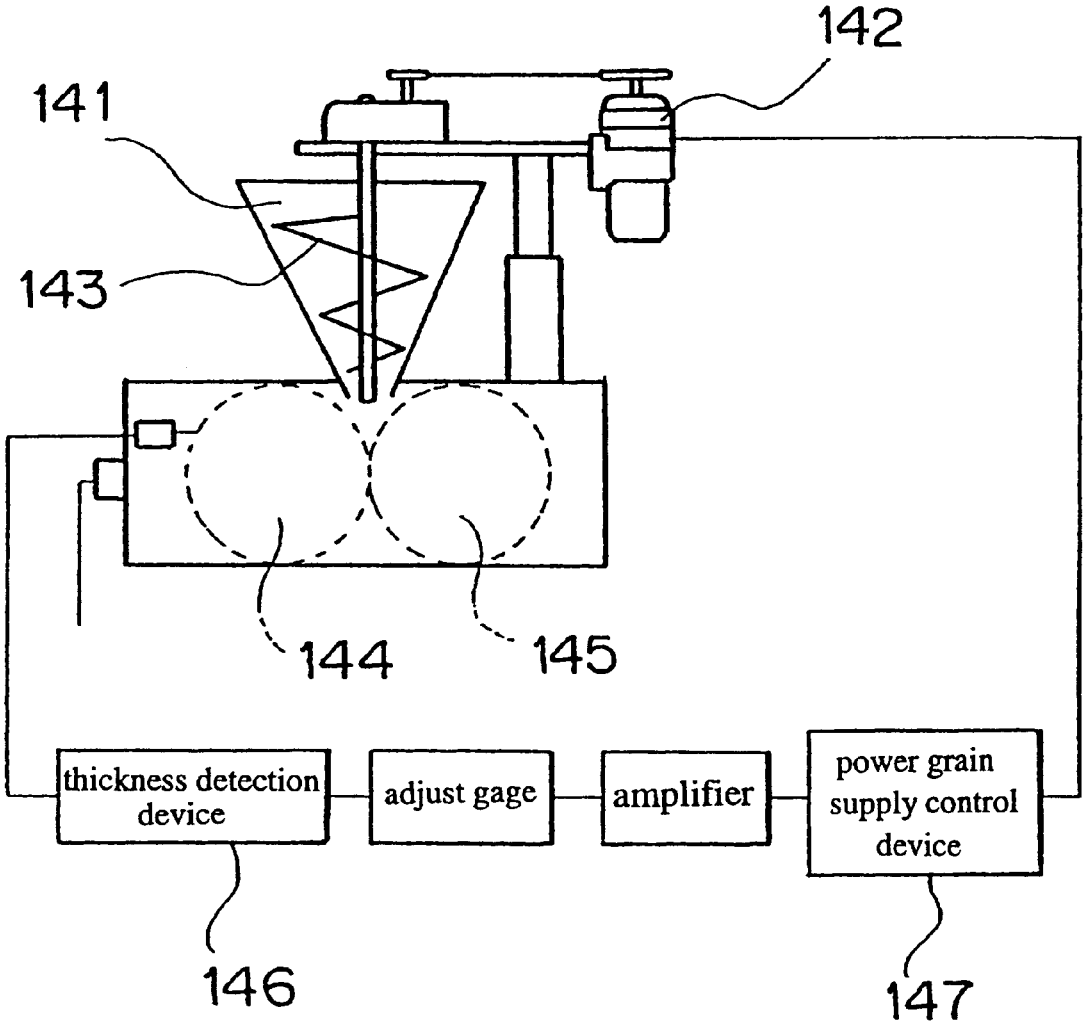
FIG. 17 is an explanatory view showing a structure of another conventional processing apparatus.

Explanation will further be made of a dry granulating apparatus which is the second embodiment of the present invention. FIGS. 11(*a*) and 11(*b*) are explanatory views showing a structure of the dry granulating apparatus (a powder grain processing apparatus) according to the present embodiment. FIG. 11(*a*) is a front view thereof and FIG. 11(*b*) is a side view thereof. FIGS. 12(*a*) and 12(*b*) are explanatory views showing a structure in a powder grain processing room of the dry granulating apparatus shown in FIGS. 11(*a*) and 11(*b*). FIG. 12(*a*) is a front view thereof and FIG. 12(*b*) is a side view thereof. Further, FIG. 13 is a plan view of the dry granulating apparatus shown in FIG. 11(*b*). The same members as those used in the embodiment 1 will be denoted at the same reference symbols, and detailed explanation thereof will be omitted herefrom.

If powder grains having a large specific volume are processed, there is a case that air included in the hopper 19 cannot be sufficiently deaerated from the hopper 19 itself at one time and that it is therefore difficult to supply a constant amount of raw material. In addition, there is a possibility that the product quality is not maintained to be constant, or decrease of the yield is involved. In particular, if the degree of consolidation influences the product characteristics, e.g., if medicinal supplies are pressed, then the stability, disintegration (solubility), titer, or the like of a medicine thus being pressed, differs in pressed parts. Therefore, the product quality is not maintained to be constant. Or the yield (which is the ratio of an actually generated amount to a theoretically expected amount in the production process) is decreased.

A method of adjusting the compression force to the powder grains, by changing the length of a screw member in a screw feeder, has been adopted on the basis of the difference of the specific volume. However, in this method, it is necessary to replace the screw member every time when the kind of powder grains is changed. Therefore, a complicated replacement service cannot be avoidable. It is also necessary to prepare a large number of replaceable parts, which may cause increase of the apparatus costs. Hence, in the powder grain processing apparatus as the embodiment 2 of the present invention, the specific volume of the powder grains is reduced step by step by providing the powder grain transport means in two stages, as shown in FIGS. 11(*a*) and 11(*b*). So, the powder grains can be supplied stably to the compression roller mechanism.

As shown in FIGS. 11(*a*) and 11(*b*), the present dry granulating apparatus also has a housing body 1 set on a floor surface G. The housing 1 is divided into a powder grain processing room 70 and a drive room 4 where a control operation panel, a motor, and the like are installed.

A first powder grain transport means 7 is provided above the housing 1. The means 7 performs primary the deaerating of the powder grains that have been vacuum-transported from the powder grain storage vessel 5 through a hose 71 by using, for example, an ejector, and then supplies the powder grains to the processing room 70. Firstly, the transport means 7 has a supply hopper 8 which temporarily stores the supplied powder grains, and a powder grain press/feed means 9 connected to a lower part of the hopper 8. In the top end side of the press/feed means 9, a discharge port 10 is provided so as to stand on the housing 1. The discharge port 10 is provided such that the lower part of the port penetrates through the housing 1 and is exposed to the inside of the processing room 70.

In this case, the press/feed means 9 comprises a screw 13 internally connected to a drive shaft 12 of a motor 11, and a transport tube 14 which perfectly seals the screw 13. The transport tube 14 is provided so as to penetrate through the supply hopper 8 from the right side of the axis of the supply hopper 8 in FIG. 11(*b*). The powder grains in the hopper 8 are fed to the discharge port 10, being involved with the spiral fin of the screw 13.

Also, the press/feed means 9 is provided with a deaerating nozzle 15 (a deaerating port) which communicates with an end part of the transport tube 14 and is located above the discharge port 10. This nozzle 15 communicates with the transport tube 14 and the discharge port 10, so that air included in the powder grains is deaerated and emitted to the atmosphere while the powder grains are transported by the screw 13. Accordingly, in the present dry granulating apparatus, raw powder grains are subjected to primary deaerating before being thrown into the processing room 70. Also, it is possible to supply stably a constant amount of powder grains to the next means, i.e., the second powder grain transport means 17 in the processing room 70. Note that an air filter 16 is attached to the nozzle 15 so that powder grains might not be discharged to the atmosphere.

Meanwhile, the transport means 17 and the roller mechanism 18 are provided in the processing room 70. In this case, the transport means 17 has a pitcher hopper 19 which receives and stores the powder grains fed from the transport means 7, and a powder grain press/feed means 20 connected to a lower part of the hopper 19 in order to vertically feed the grains, like the transport means shown in FIG. 4.

The press/feed means 20 is provided above the housing 1 and is deviated with respect to the press/feed means 9, as shown in FIGS. 12(*a*) and 12(*b*) and 13. Also, the discharge port 10 of the transport means 7 is positioned at the center of the hopper 19, and the powder grains discharged from the discharge port 10 are supplied to the center of the hopper 19. In the present dry granulating apparatus, the transport means 7 is provided above the housing 1 and deviated with respect to the center axis of the transport means 17. Accordingly, the press/feed means 9 and the press/feed means 20 are arranged so as to be perpendicular to each other, so that the entire apparatus can be compact. The structure not described in the embodiment 2 is the same as that of the dry granulating apparatus according to the embodiment 1.

Thus, in the dry granulating apparatus according to the embodiment 2, the specific volume of the powder grains can be decreased step by step since the powder grain transport means has the first and second stages. It is therefore possible to achieve stable supply of the powder grains to the roller mechanism. Accordingly, flake-like compression moldings having a uniform shape can be formed by the compression roller mechanism.

Although the invention made by the present inventor has been specifically explained above, the present invention is not limited to the embodiments described above but can be variously changed without departing from the subject matter of the invention.

For example, in the above embodiments, a barrel made of porous metal is used as the barrel 24. However, the barrel 24 may be a barrel in which a filter made of unwoven fabric, paper, cloth, a synthetic resin film, or the like that has pores. In addition, although the condition of the rollers 38*a* and 38*b* is detected by the sensor 51 attached to the frame 42, the pressure of the powder grains in the introduction/compression part 50 may be directly measured by a pressure sensor. Also, the condition can be detected by measuring the displacement amount or distortion of the side seals 37, the distance between the axes of the rollers 38*a* and 38*b*, or the distortion of the shafts.

The above description has been made of a case where the invention made by the present inventor is applied to a dry granulating apparatus which belongs to the applied field of the present invention. However, the present invention is not limited hitherto but may be applied to other powder grain processing apparatuses for pressing and shaping the powder grains.

Industrial Applicability

As has been described above, the powder grain processing apparatus of the present invention is provided with side seals which do not contact compression rollers. Powder grains enter between the rollers and the side seals, thereby forming closer layers which prevent leakage of the powder grains in the compression roller mechanism. Therefore, the side seals are not pressed in direction of the compression rollers by an actuator or the like, unlike conventional apparatuses.

Accordingly, abrasion powders caused by contact between the compression rollers and the side seals can be prevented from mixing into products and the products can be prevented from becoming dirty, so that quality of the products can be stabilized.

The compression rollers or side seals need not be pressed by an actuator such as a hydraulic cylinder or the like, so that there is not a risk that the products may be polluted by oil contamination or abrasion powders from operating parts. In addition, since a distance between the frames is shorter than a conventional compression roller mechanism, the compression roller support shafts are short so that since no actuator is needed, the compression roller mechanism can have a strong rigid structure. Further, number of parts can be reduced in comparison with a conventional roller mechanism. The apparatus price can be reduced and the maintenance thereof can be easily performed.

Since a sensor for detecting motion of the compression roller mechanism is provided, it is possible to detect directly a pressure generated by the powder grains pressed or expanded. Accordingly, the physical characteristics, such as the hardness of the powder grains or the like, can be informed on real time.

If a porous deaerating barrel and a deaerating jacket surrounding the deaerating barrel are used as the powder grain transport means, the apparent specific volume of the powder grains can be much more increased so that the powder grains having a higher bulk density can be supplied to the compression roller mechanism. Accordingly, it is possible to obtain compression moldings having a more uniform shaping condition at a higher yield. In addition, the deaerating barrel and the deaerating jacket can be replaced with ones corresponding to the supply amount of the powder grains. Therefore, the bulk density and the apparent specific volume of the powder grains supplied to the compression roller mechanism can be appropriately adjusted.

Inside of a housing is divided into a powder grain processing room and a drive room by a partition wall, and the powder grain processing room has a watertight structure in which the inside of the powder grain processing room can be automatically cleaned by a cleaning device. Therefore, both inside and outside of each of various devices set in the powder grain processing room can be automatically cleaned, so that a powder grain processing apparatus which complies with GMP can be provided. In addition, since the inside of the housing is divided, maintenance and inspection can be easily performed.

A pitcher hopper and the like are arranged to move upward and downward in the powder grain processing room by the elevation mechanism. It is therefore possible to change appropriately the distance between the screw end part and the compression rollers. Accordingly, it is not necessary to prepare a large number of screws having different lengths or replace appropriately the screws in accordance with kinds of powder grains, so that it is possible to process widely various types of powder grains by only one screw. Also, services for replacing screws and number of types of the screws can be reduced.

Since load torque of the shearing device is detected, condition, such as fragility or the like, of the compression moldings can be expressed as a numerical value. Accordingly, the operation of the powder grain press/feed means and the compression rollers can be automatically controlled on the basis of the detection value. As a result of this, it is not necessary to carry out condition being set as depending on operator's intuition, so that compression moldings with stable quality can be obtained constantly. In addition, the condition of compression moldings need not be monitored minute by minute. Further, measurement of fragility or the like can be carried out during operation, so that time and labor necessary for performing granulation can be reduced and efficiency of the manufacturing can be improved.

What is claimed is:

1. An apparatus for processing powder grains, having a pair of compression rollers parallel to each other and supplying powder grains between the compression rollers, thereby forming compression moldings of the powder grains, the apparatus comprising:

a pitcher hopper provided in a front stage of the compression rollers and storing the powder grains supplied to the compression rollers; and a powder grain press/feed means connected to the pitcher hopper and arranged between the pitcher hopper and the compression rollers and pressing and feeding the powder grains to the compression rollers, wherein the powder grain press/feed means has a transport tube internally including a screw member for pressing and feeding the powder grains, and the pitcher hopper is provided to be movable relatively to the screw member.

2. An apparatus for processing powder grains, having a pair of compression rollers parallel to each other and supplying powder grains between the compression rollers, thereby forming compression moldings of the powder grains, the apparatus comprising:

a pitcher hopper provided in a front stage of the compression rollers and storing the powder grains supplied to the compression rollers; and a powder grain press/feed means connected to the pitcher hopper and arranged between the pitcher hopper and the compression rollers and pressing and feeding the powder grains to the compression rollers, wherein the powder grain press/feed means has a transport tube internally including a screw member for pressing and feeding the power grains, and the pitcher hopper and the transport tube are provided to be movable relatively to the screw member.

3. An apparatus for processing powder grains, having a pair of compression rollers parallel with each other and supplying powder grains between the compression rollers, thereby forming compression moldings of the powder grains, the apparatus comprising:

a pitcher hopper provided in a front stage of the compression rollers and storing the powder grains supplied to the compression rollers; and a powder grain press/feed means connected to the pitcher hopper and arranged between the pitcher hopper and the compression rollers and pressing and feeding the powder grains to the compression rollers, wherein the powder grain press/feed means has a transport tube internally including a screw member for pressing and feeding the powder grains, and the screw member is provided to be able to change a distance between the screw member and the compression rollers.

4. An apparatus for processing powder grains, having a pair of compression rollers arranged in parallel with each other and supplying powder grains to a powder grain introduction/compression part formed between the compression rollers, thereby forming compression moldings of the powder grains, the apparatus including a seal member being provided to face side surfaces of the compression rollers in a non-contact condition in which clearance is maintained from the compression rollers and forming closer layers of the powder grains between the seal members and side surfaces of the compression rollers when the powder grains enter into the clearance, thereby sealing the powder grain introduction/compression part.

5. An apparatus according to claim 1, further comprising:

a pressure detection means for detecting a pressure which the powder grains receive when the powder grains are compressed between the compression rollers; and a control means for adjusting hardness of the powder grains fed from the compression rollers in accordance with the pressure detected by the pressure detection means.

6. An apparatus according to claim 1, further comprising:

a fine change amount detection means for detecting a fine change of distance between the compression rollers, the fine change being caused by a pressure which the powder grains receive when the powder grains are pressed between the compression rollers; and a control means for adjusting hardness of the powder grains fed from the compression rollers in accordance with a fine change amount of the distance between the compression rollers, the fine change amount being detected by the fine change amount detection means.

7. An apparatus according to claim 5, wherein the control means adjusts a pressure applied to the powder grains.

8. An apparatus according to claim 1, further comprising:

a pair of compression roller support shafts for supporting the compression rollers;

a compression roller support part for holding the compression roller support shafts;

a distortion detection means attached to the compression roller support part and measuring distortion caused at the compression roller support part by a pressure which the compression rollers receive when the powder grains are pressed between the compression rollers; and a control means for adjusting the pressure applied to the powder grains in accordance with a distortion value caused at the compression roller support part, the distortion value being obtained by the distortion detection means.

9. An apparatus according to claim 5, wherein the powder grain processing apparatus further comprises a powder grain press/feed means for feeding the powder grains to the compression rollers, and the control means controls the powder grain press/feed means, thereby adjusting a feed amount of the powder grains.

10. An apparatus according to claim 5, wherein the control means controls a rotation speed of the compression roller.

11. An apparatus according to claim 1, further comprising:

a powder grain processing room sealing hermetically and containing the compression rollers in a watertight condition; and a cleaning means provided in the powder grains processing room and injecting a cleaning liquid into the powder grain processing room.

12. An apparatus according to claim 11, wherein the cleaning means is provided at least one of an upper part and side parts of the powder grain processing room.

13. An apparatus for processing powder grains, having a pair of compression rollers parallel with each other and a powder grain press/feed means for supplying powder grains to the compression rollers, for supplying the powder grains between the compression rollers with use of the powder grain press/feed means, hereby forming compression moldings of the powder grains, the apparatus comprising:

a shearing means provided in a rear stage of the compression rollers and shearing the compression moldings formed by the compression rollers; and a load detection means for detecting a load applied to the shearing means.

14. An apparatus according to claim 13, further comprising a control means for controlling at least one of the powder grain press/feed means and the compression rollers in accordance with data detected by the load detection means.

15. An apparatus according to claim 13, wherein the load detection means detects rotation torque of the shearing means.

16. An apparatus according to claim 1, wherein the powder grain processing apparatus is a roller compactor by dry granulating apparatus.

17. A method for processing powder grains, having a step of supplying powder grains between a pair of compression rollers arranged in parallel with each other, with use of a powder grain press/feed means provided in a front stage of the compression rollers, thereby forming compression moldings of the powder grains, the method comprising:

a step of detecting a load applied to a shearing means during shearing the compression moldings formed by the compression rollers by means of the shearing means provided in a rear stage of the compression rollers; and a step of controlling at least one of the powder grain press/feed means and the compression rollers in accordance with the load detected.

18. A method according to claim 17, wherein the load is rotation torque for driving the shearing means.

* * * * *